US005944064A

United States Patent [19]

Saito et al.

[11] Patent Number: 5,944,064

[45] Date of Patent: Aug. 31, 1999

[54] TYING METHOD AND TYING APPARATUS FOR ARTICLES

[75] Inventors: Tsutomu Saito; Seiichi Takahashi; Hirokazu Watanabe, all of Tokyo, Japan

[73] Assignee: Japan Automatic Machine Co., Ltd., Tokyo, Japan

[21] Appl. No.: 08/894,148

[22] PCT Filed: Feb. 16, 1996

[86] PCT No.: PCT/JP96/00343

§ 371 Date: Aug. 13, 1997

§ 102(e) Date: Aug. 13, 1997

[87] PCT Pub. No.: WO96/25330

PCT Pub. Date: Aug. 22, 1996

[30] Foreign Application Priority Data

Feb. 17, 1995 [JP] Japan ..... 7-052001
Dec. 28, 1995 [JP] Japan ..... 7-352209

[51] Int. Cl.[6] ..... B21F 15/04

[52] U.S. Cl. ..... 140/119; 140/57

[58] Field of Search ..... 140/54, 57, 93 A, 140/119; 310/48

[56] References Cited

U.S. PATENT DOCUMENTS 3,880,204 4/1975 Sarff et al. ..... 140/119
5,170,851 12/1992 Kress et al. ..... 310/47
5,431,196 7/1995 Forrester, Jr. et al. ..... 140/119
5,558,134 9/1996 Miyazaki ..... 140/57
5,682,927 11/1997 Takahashi et al. ..... 140/119

FOREIGN PATENT DOCUMENTS 58-177275 10/1983 Japan .
6-115509 4/1994 Japan .
6-99926 4/1994 Japan .
6-167115 6/1994 Japan .
6-278049 10/1994 Japan .

*Primary Examiner*—Lowell A. Larson
*Attorney, Agent, or Firm*—Armstrong, Westerman, Hattori, McLeland & Naughton

[57] ABSTRACT

An engaging portion in engagement with a tying material and a hook, as a twisting mechanism, are mounted on an oscillating member provided on a spindle, and the continuous linear tying material is fed in a direction crossing a spindle axis into engagement with the engaging portion to form a starting point which is folded into a U-shape. In this state, the tying material is delivered to an encompassing guide to thereby guide the tying material around articles to be tied together, while forming two wires by folding the tying material into a substantially U-shape by a feeding force. The engaging portion and the hook are integrally rotated so that a folded extreme end portion and a rear end portion on the other side of the tying material are twisted together with each other to tie articles together. Accordingly, tying can be firmly done with one winding, while forming two wires by automatically folding the continuous linear tying material in half.

19 Claims, 16 Drawing Sheets

TYING METHOD AND TYING APPARATUS FOR ARTICLES

TECHNICAL FIELD OF THE INVENTION

The present invention relates to a tying method and a tying apparatus therefor for automatically tying various articles by linear tying materials, such tyings including a tying of bar-like articles such as reinforcements, pipes and various other articles, a tying of heat insulating sheets wound about, for example, pipes, air conditioning ducts or similar, a tying of bag openings, a tying of a single article such as repair of fishing nets, medical binding or sewing-up, etc.

BACKGROUND OF THE INVENTION

In the past, in the operation for arrangement of reinforcements in construction work, for example, the tying and securing of portions of reinforcements placed one above another have been generally carried out by manual operation. An iron wire is bent in advance into two parts so as to have a U-shape. The U-shaped wire is extended over a portion of reinforcements placed one above another. A hook portion of a jig, called a twist shaft is hung on a bent portion of the iron wire and is then rotated several times to twist opposite ends of the iron wire to each other to bind the portions placed one above another. To obtain the positive tying, great skill and heavy labor is required, resulting in poor operating efficiency. Thus, mechanization therefor has been demanded.

Further, a tying machine for automatically tying reinforcements has been proposed. However, tying machines thus proposed suffer from a problem in that any one of these machines is complicated in construction, is heavy in weight, is high in manufacturing cost, and is inconvenient in handling. Further, in any one of these conventional machines, a single iron wire is drawn out of a bobbin and wound around a joined portion of reinforcements with that single iron wire to bind the joined portion, and therefore it is necessary to wind the object several times in order to provide a firm tying. A long tying material is required as compared with the tying through manual operation, resulting in a higher cost of tying materials. A further problem is that the single wire tends to be ruptured, and a strong tying force is hard to obtain as compared with the tying through manual operation for effecting the tying after the iron wire is bent into two parts to form a double configuration.

For solving the above-described problems, the present inventors have previously proposed a method and an apparatus therefor for automatically bending a continuous linear tying material drawn out of a bobbin or similar to form two wires to provide powerful tying by a single winding (International Application International Laid-Open Publication No. WO95/05313).

The tying method and the tying apparatus therefor, proposed as described above, are further improved by the present invention. It is an object of the present invention to provide a tying method and a tying apparatus therefor which is simple in mechanism, is less in the number of parts, is light-weight, is less in load imposed on a motor to prolong the service life of the motor, and can firmly and positively tie articles by a short tying material as compared with the prior art.

SUMMARY OF THE INVENTION

The method of tying articles, according to the present invention for achieving the aforementioned object, is characterized by comprising: a tying material bending step of holding a substantially extreme end portion of a continuous linear tying material being delivered by tying material holding means to apply a resistance to form a starting point at which the tying material is bent into a substantially U-shape; an encompassing and guiding step of guiding the tying material around an article to be tied while bending the former into a substantially U-shape; a tying material cutting step of cutting a rear end portion of the tying material from a continuous wire at a suitable time; and a twisting step of twisting a bent extreme end portion and a rear end portion on the other side of the tying material together to band together the articles to be tied, the bent extreme end portion and the rear end portion on the other side of the tying material being twisted together while the tying material holding means and the twisting means are rotated integrally.

Further, the aforementioned object can be further achieved, in the method of tying articles comprising the above-described steps, by employing a method characterized in that a tying material is fed to the tying material holding means from a direction crossing an axis of a spindle to have an extreme end portion engaged with the tying material holding means; a method characterized in that a bent extreme end portion and a rear end portion on the other side of a tying material are twisted together with each other while the tying material holding means and the twisting means are integrally displaced in an axial direction of a spindle; a method characterized in that a bent extreme end portion and a rear end portion on the other side of a tying material are twisted together with each other while the tying material holding means and the twisting means are integrally displaced towards articles to be tied; more preferably, all the methods described above.

In the aforementioned encompassing and guiding step, the bent extreme end portion of the tying material moved out of the encompassing and guiding means is automatically guided to a position in engagement with the twisting means whereby the bent extreme end portion can be positively engaged with the hook.

Further, the tying material holding means is displaced toward the articles to be tied integral with the tying material twisting means during the twisting step to thereby firmly band together the articles to be tied together. It is to be noted that the movement of the tying material holding means and the tying material twisting means toward the articles to be tied together requires that the engaging position of the holding and twisting means with the tying material is displaced toward the articles to be tied together so that the distance, with respect to the articles to be tied together, is lessened; and that the displacement in the axial direction of the spindle requires that the holding and twisting means are oscillated and displaced so that the engaging position with respect to the tying material comes close to the spindle axis.

Further, the apparatus of tying articles, according to the present invention for achieving the aforementioned object, comprises tying material delivery means for delivering a continuous linear tying material; tying material holding means for holding a substantially end portion of the tying material delivered from the tying material delivery means; encompassing and guiding means for guiding a tying material around articles to be tied together, while the tying material is being bent into a substantially U-shape in a state where a substantially end portion thereof is held by the tying material holding means; cutting means for cutting the tying material into a predetermined length; and twisting means for twisting opposite ends of the tying material together, characterized in that the tying material holding means is provided on a spindle body to be rotated and driven and is rotated integrally with the twisting means.

Preferably, the tying material holding means and the twisting means are provided on the spindle body so that they can be displaced toward the articles to be tied together as the twisting progresses, and more preferably, the tying material holding means and the twisting means are provided on an oscillating member provided on the spindle body in an oscillating manner.

The tying material holding means is formed from a groove-like engaging portion in which a tying material, provided at a substantially extreme end portion of the oscillating member, is fitted and the tying material twisting means is formed from a hook provided adjacent to the engaging portion. Alternatively, the twisting means can be provided on the oscillating member in an oscillating manner so as to be oscillated positively in a direction of a bent extreme end portion of a tying material from the oscillating member so as to come into engagement with the bent extreme end portion of the tying material.

Further, a fixed member for rotatably holding the spindle body is formed with a tying material guide hole for guiding the tying material in a direction crossing a spindle axis, the spindle body being formed with a tying material extending-through hole in communication with the tying material guide hole to cause the tying material to extend through in a direction crossing the spindle axis. The tying material is held by the tying material holding means in a direction crossing the spindle axis, whereby engaged rear ends of the tying material can be positively twisted together without requiring a special biasing member or similar.

Since the cutting means is formed by relative rotational movement of the tying material guide hole and the tying material extending-through hole, it is not necessary to provide a special cutter and cutter driving means, and the number of parts can be reduced.

The spindle body is provided so as to be displaced toward the articles to be tied together as the twisting progresses and comprises a spindle rotated and driven by a main motor and a spindle extreme end portion pivotally mounted on the extreme end thereof. More preferably, the oscillating member is provided at the extreme end portion of the spindle extreme end member so that as the spindle body is displaced toward the articles to be tied together as the twisting progresses, the spindle extreme end member oscillates so as to reduce the rotational radius of the twisting means. It is to be noted in the present invention that the main motor and a tying material feed motor need not be separated, but for example, they can be connected to each other by a clutch mechanism so that the tying material feed means and the twisting means are driven by a single motor.

Further, another tying apparatus according to the present invention comprises a tying material bobbin mounting frame portion, a driving control portion, a tying mechanism portion, an encompassing and guiding portion and a tying material cutting portion, the driving control portion comprising a tying material feed motor, a main motor for rotating and driving a spindle body of the tying mechanism portion, and a control circuit portion for controlling the tying material feed motor and the main motor, the driving control portion being characterized by being capable of being integrally detached from the tying material bobbin holding portion and the tying mechanism portion, a worn driving control portion is capable of being replaced for use.

Still another tying apparatus according to the present invention comprises a tying material feed motor, tying material feed means rotated and driven by the tying material feed motor, a main motor, and a tying mechanism portion having a hook rotated and driven by the main motor, characterized in that the apparatus is separated into at least a tying apparatus body having the tying mechanism portion and at least a separate casing body having the tying material feed motor, and a tying material is fed from the separate casing to the tying mechanism portion of the tying apparatus body by the tying material feed motor held on the separate casing body. The tying operation can be carried out by manually holding only the small and light-weight tying apparatus body and the fatigue of the tying operation can be relieved and the operation can be carried out comfortably.

The aforementioned main motor can be provided on either the tying apparatus body or the separate casing body. In a case where the main motor is provided on the separate casing, a rotating torque is transmitted to the tying mechanism portion through a flexible shaft. The tying material feed means can also be provided on either the separate casing body or the tying apparatus body. In a case where the tying material feed means is provided on the tying apparatus body, it is rotated and driven through the flexible shaft from the tying material feed motor provided on the separate casing body, and the tying material can be drawn out of the tying material bobbin held on the separate casing body on the side of the tying apparatus body to prevent the tying material from bending in half and to enable supplying of a tying material in a lighter and better way.

BRIEF DESCRIPTION OF THE DRAWING FIGURES

Figure 4A:
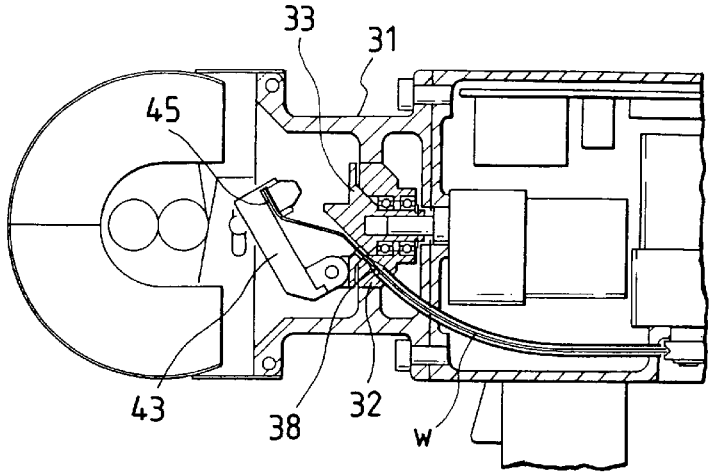
Figure 4B:
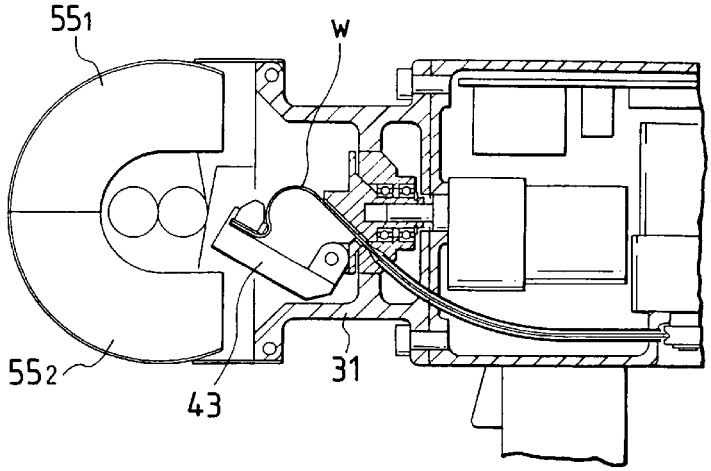
Figure 4C:
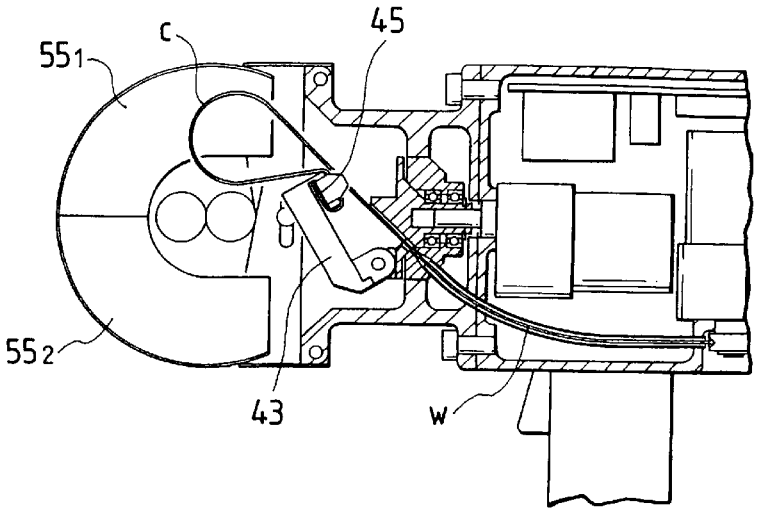
Figure 5A:
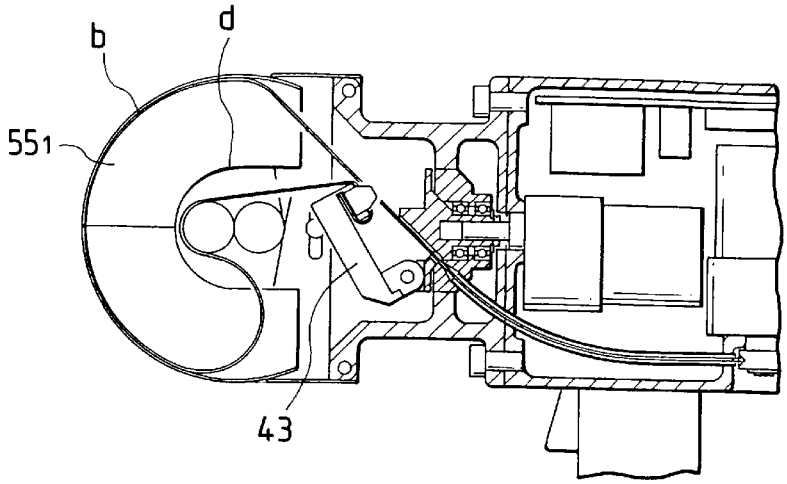
Figure 5B:
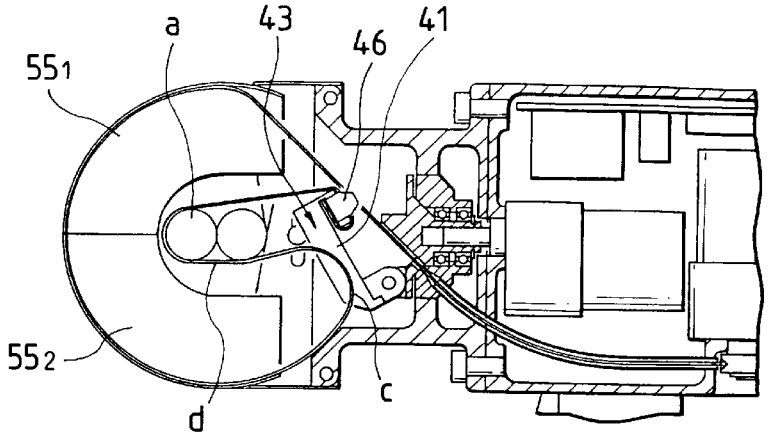
Figure 5C:
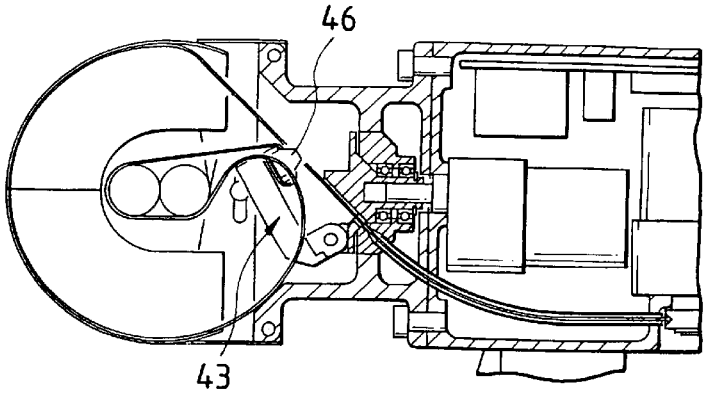
Figure 6A:
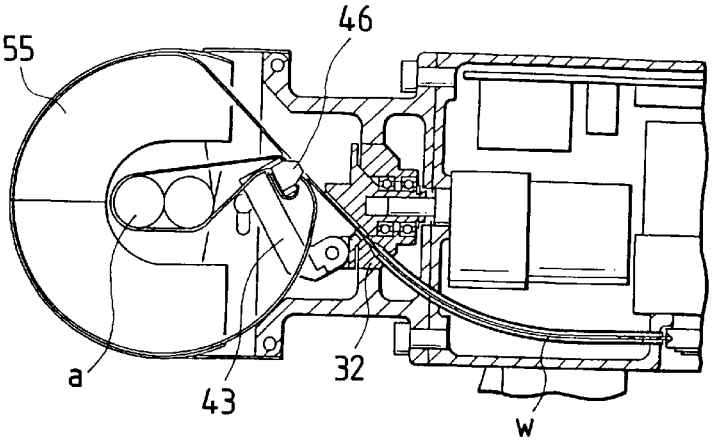
Figure 6B:
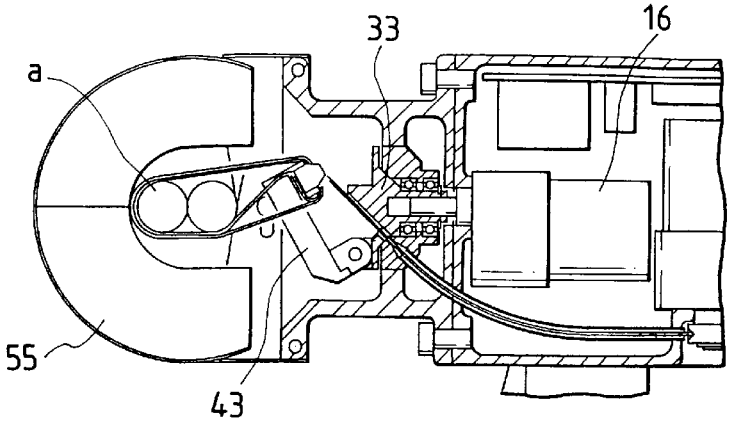
Figure 6C:
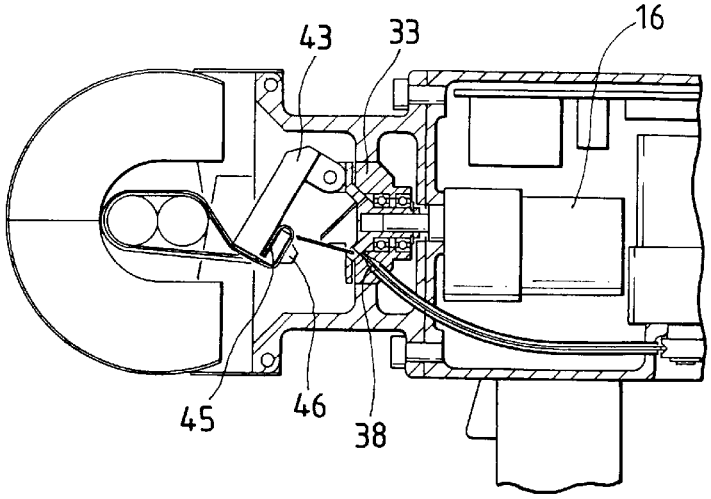
Figure 7:
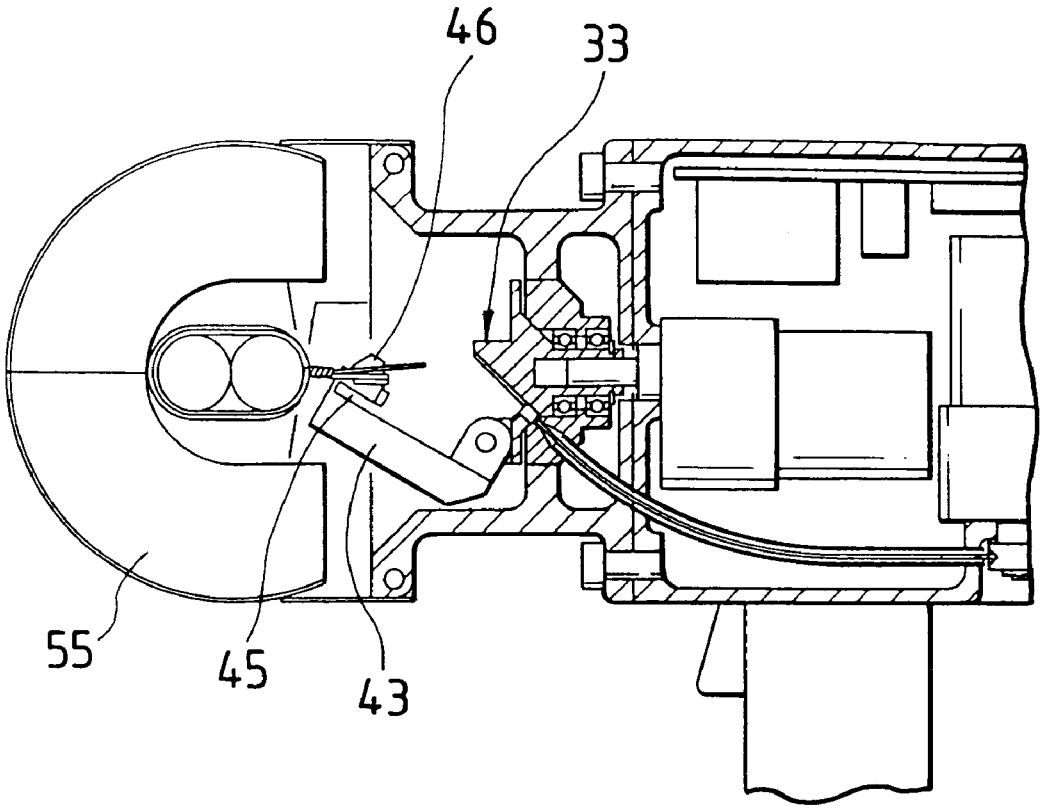
Figure 8A:
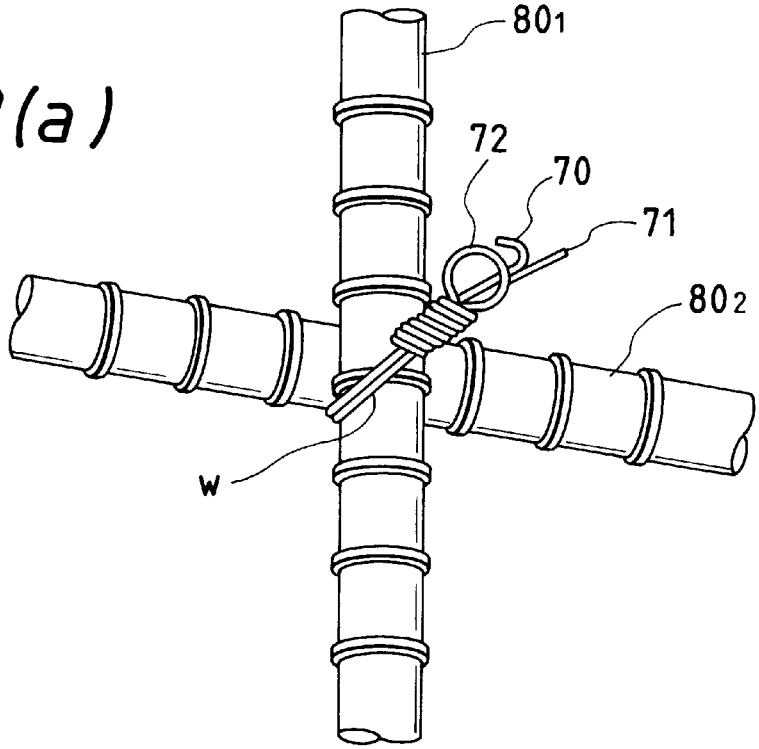
Figure 8B:
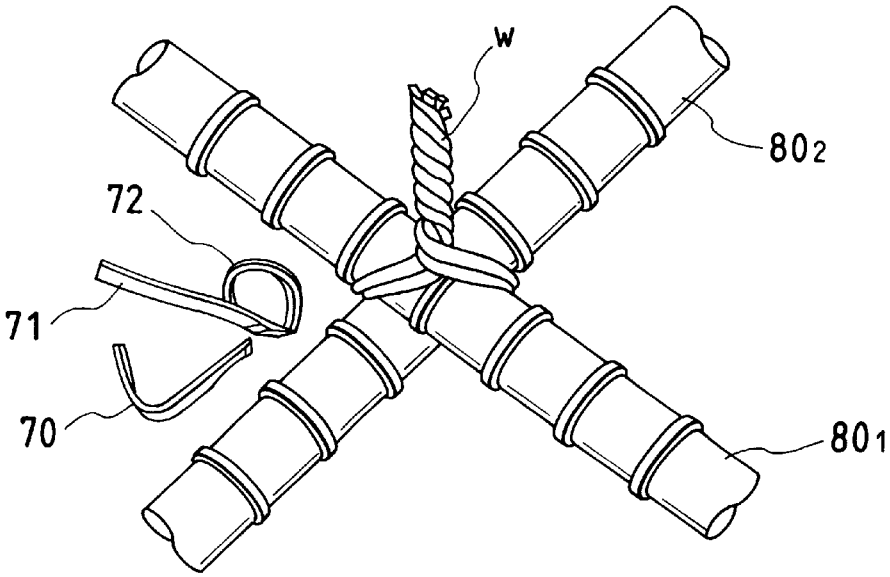
Figure 9A:
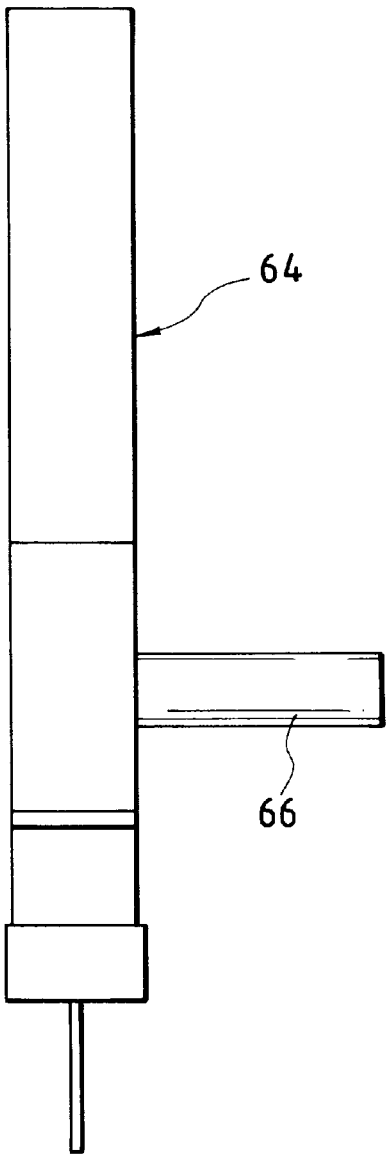
Figure 9B:
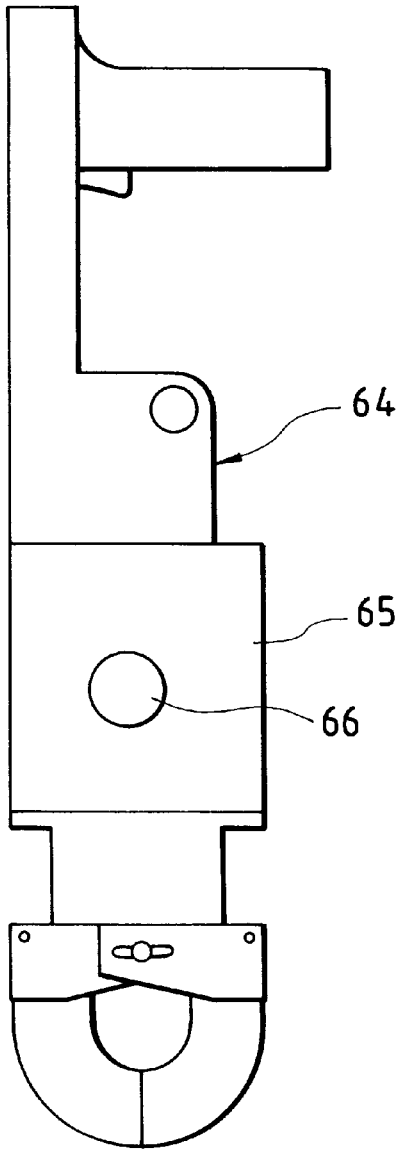
Figure 10A:
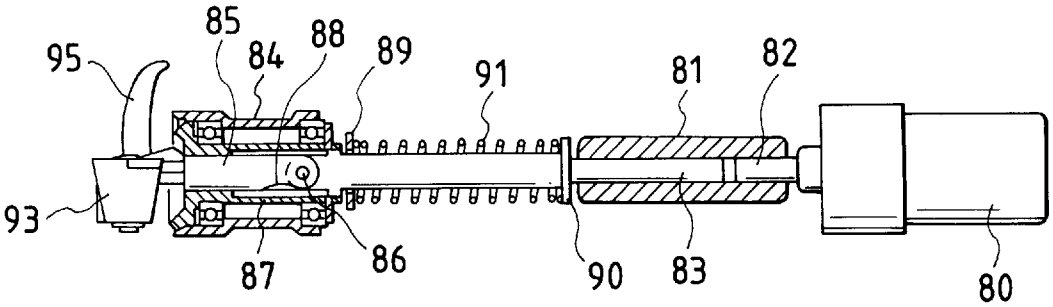
Figure 10B:
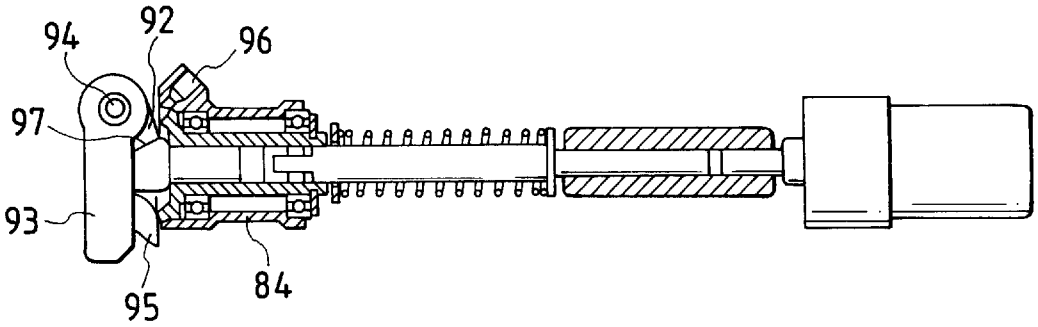
Figure 10C:
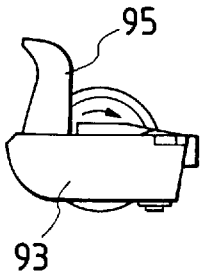
Figure 11A:
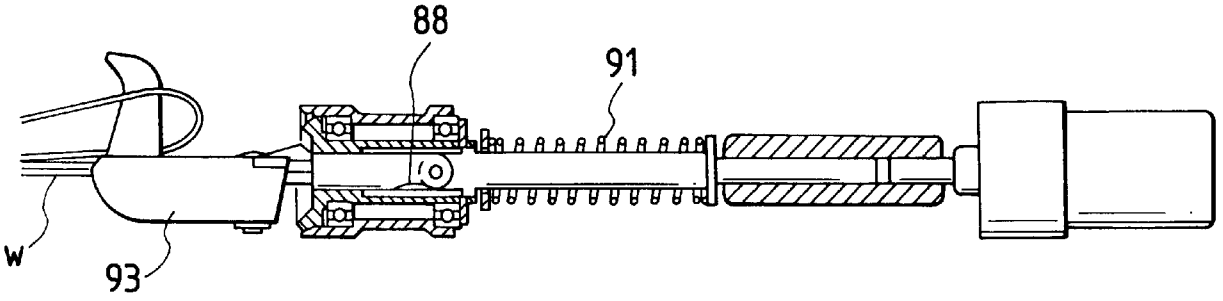
Figure 11B:
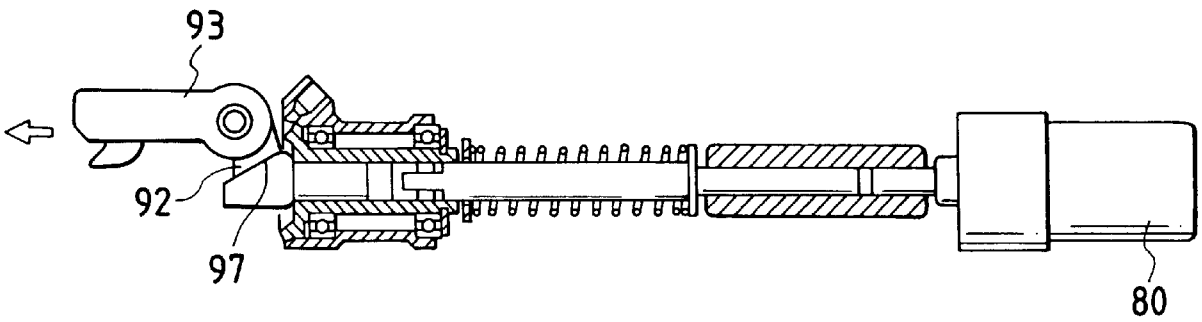
Figure 11C:
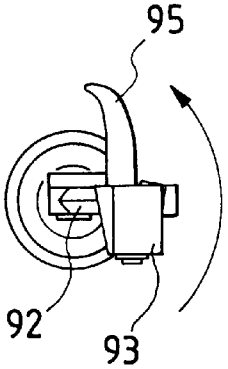
Figure 12A:
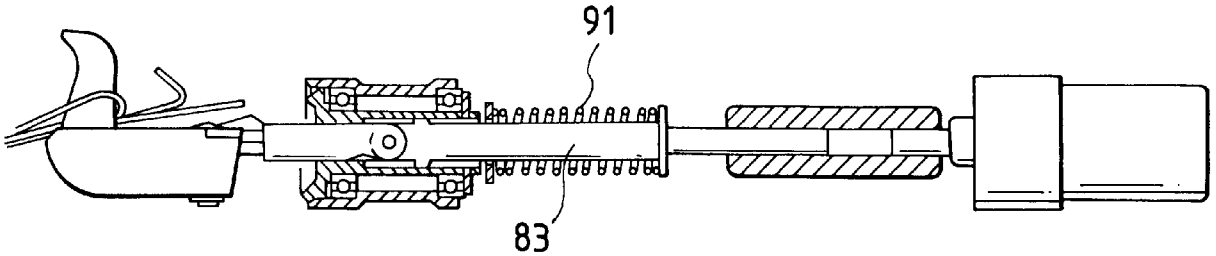
Figure 12B:
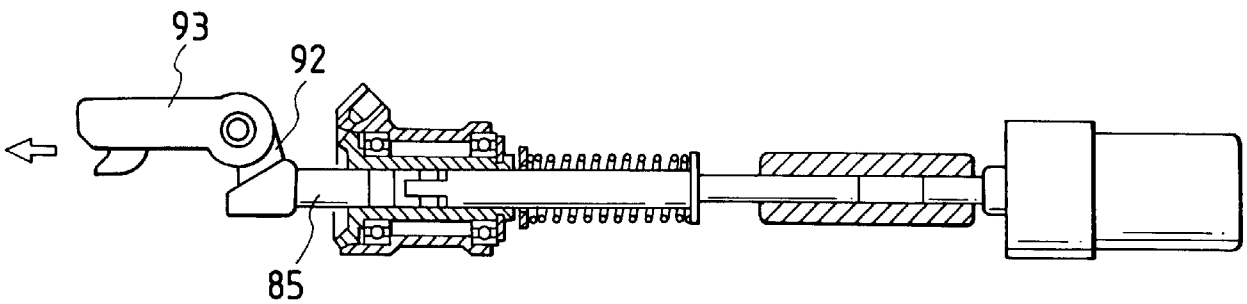
Figure 12C:
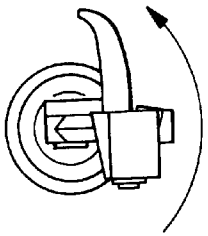
Figure 13A:
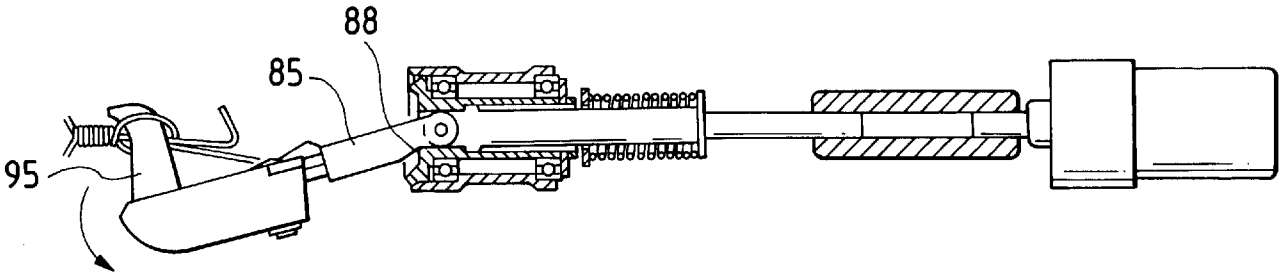
Figure 13B:
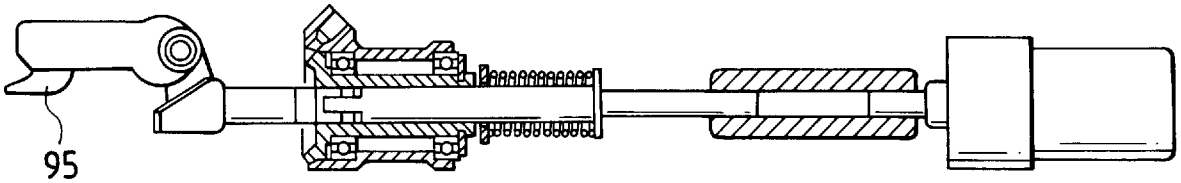
Figure 13C:
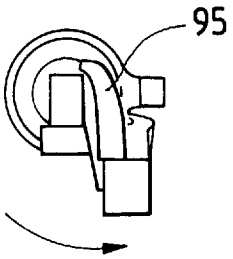
Figure 14A:
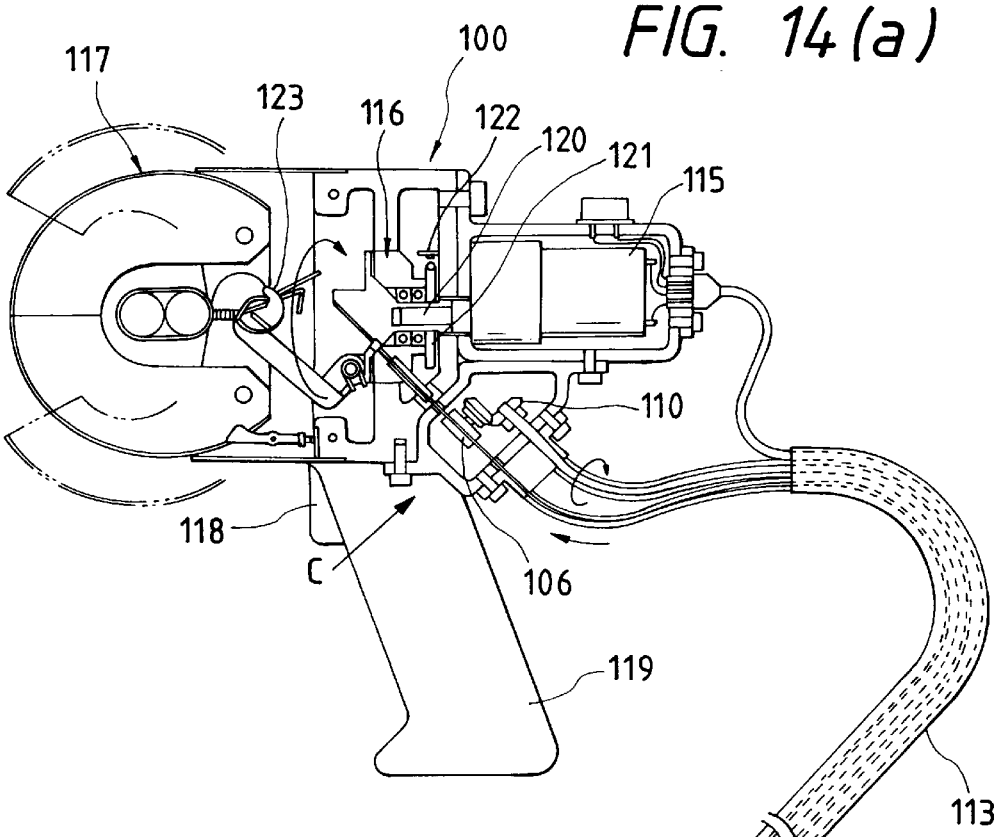
Figure 14B:
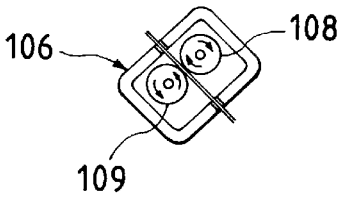
Figure 14B:
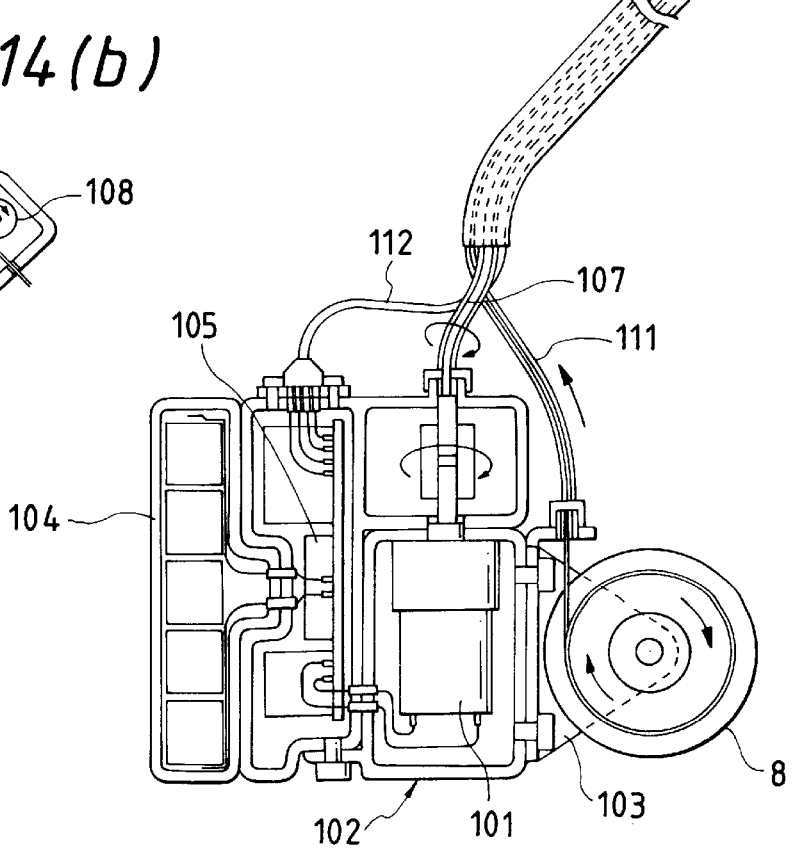
Figure 15A:
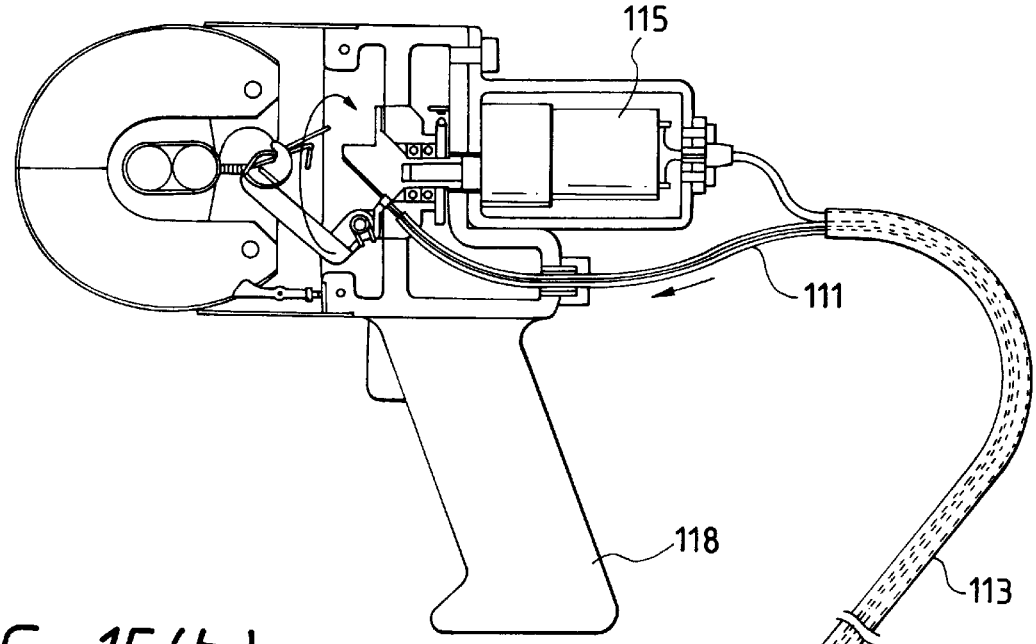
Figure 15B:
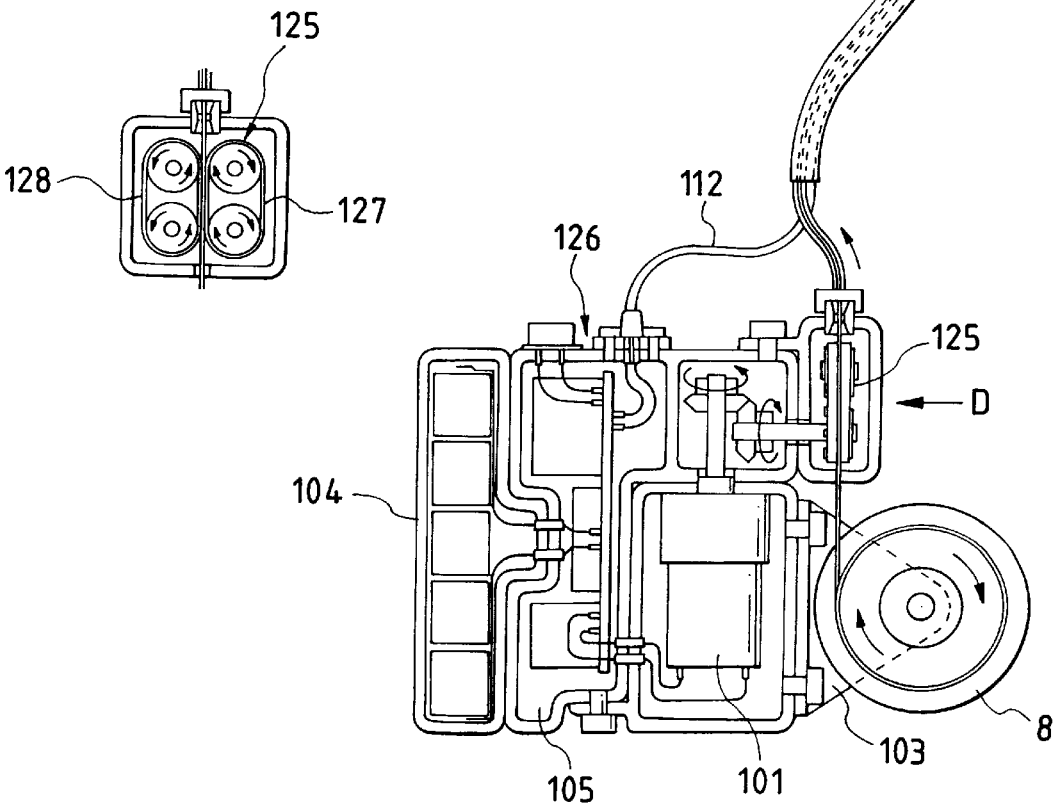
Figure 16:
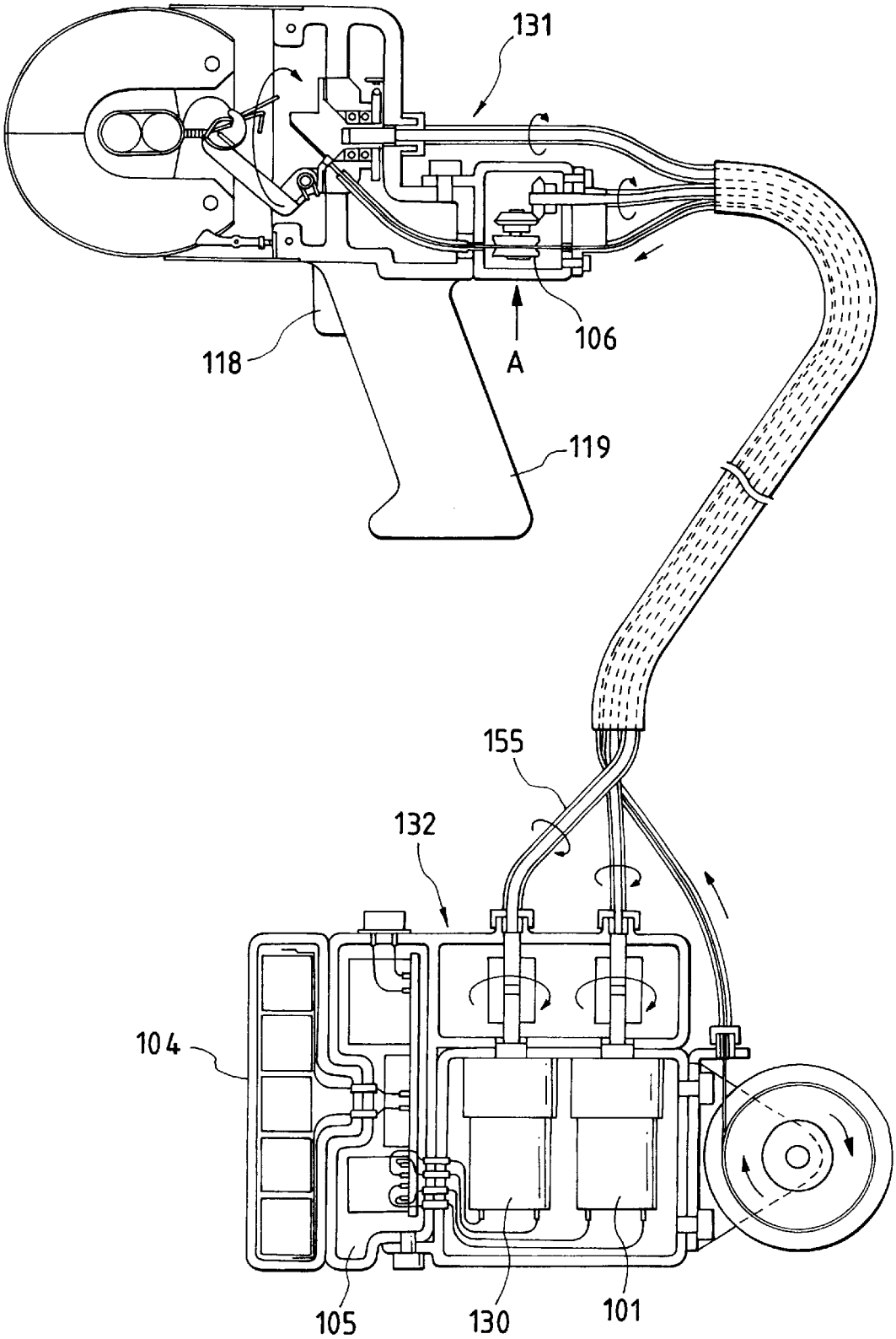
Figure 17:
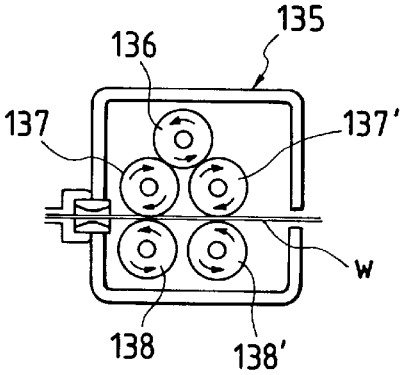
Figure 18A:
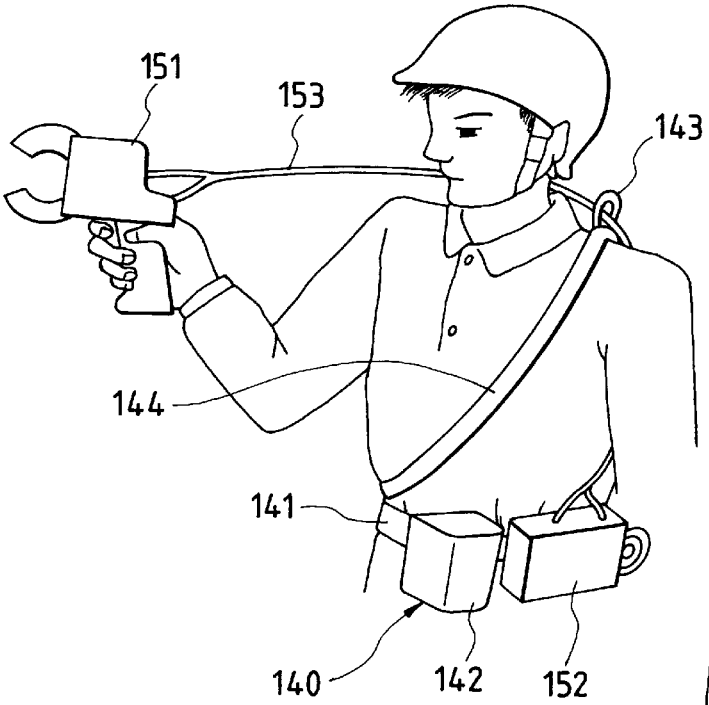
Figure 18B:
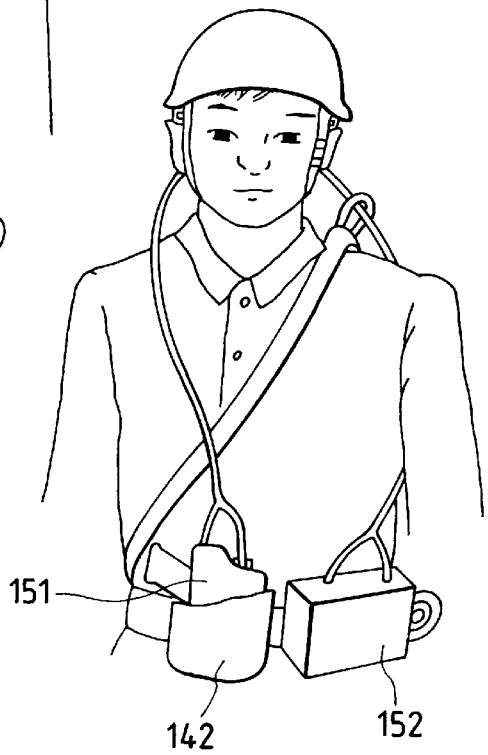

FIGS. 4(*a*) to 4(*c*) illustrate the steps of a tying operation;

FIGS. 5(*a*) to 5(*c*) illustrate the steps of the tying operation following FIG. 4;

FIGS. 6(*a*) to 6(*c*) illustrate the steps of the tying operation following FIG. 5;

FIG. 7 illustrates the tying operation following FIG. 6;

FIG. 8(*a*) is a perspective view showing the mode of tying reinforcements by the tying apparatus according to the present invention, and FIG. 8(*b*) is a perspective view showing another mode of tying reinforcements by the tying apparatus according to the present invention;

FIG. 9(*a*) is a plan view of the tying apparatus according to another embodiment of the present invention, and FIG. 9(B) is a side view thereof;

FIGS. 10(*a*) to (*c*) show another embodiment of the tying mechanism of the tying apparatus according to the present invention, wherein FIG. 10(*a*) is a partly cross-sectional plan view, FIG. 10(*b*) is a partly cross-sectional front view, and FIG. 10(*c*) is a left side view;

FIGS. 11(*a*) to (*c*) show midway through the tying operation of the tying mechanism shown in FIG. 10, wherein FIG. 11(*a*) is a partly cross-sectional plan view, FIG. 11(*b*) is a partly cross-sectional front view, and FIG. 11(*c*) is a left side view;

FIGS. 12(*a*) to (*c*) show the state where the tying operation of the tying mechanism shown in FIG. 10 is further progressed, wherein FIG. 12(*a*) is a partly cross-sectional plan view, FIG. 12(*b*) is a partly cross-sectional front view, and FIG. 12(*c*) is a left side view;

FIGS. 13(*a*) to (*c*) show the state where the twisting of the tying mechanism, shown in FIG. 10, is completed, wherein FIG. 13(*a*) is a partly cross-sectional plan view, FIG. 13(*b*) is a partly cross-sectional front view, and FIG. 13(*c*) is a left side view;

FIG. 14(*a*) is a side schematic view in a state where a cover of the tying apparatus, according to another embodiment of the present invention, is removed, and FIG. 14(*b*) is view taken in a direction of arrow C;

FIG. 15(*a*) is a side schematic view in a state where a cover of the tying apparatus, according to another embodiment of the present invention, is removed and FIG. 15(*b*) is view taken in a direction of arrow C;

FIG. 16 is a side schematic view in a state where a cover of the tying apparatus, according to still another embodiment of the present invention, is removed;

FIG. 17 is a schematic side view showing another embodiment of the tying material feed means in the tying apparatus according to the present invention; and FIGS. 18(*a*) and (*b*) show a state where an operator wears the tying apparatus, according to the embodiment of the present invention, using a wearing and holding instrument, wherein FIGS. 18(*a*) and (*b*) show the state where the operation of tying is being carried out and the state where the operation of tying is being stopped, respectively.

BEST MODE OF EMBODYING THE INVENTION

The embodiments of the tying apparatus, according to the present invention, will be described in detail hereinafter with reference to the drawing figures.

A tying apparatus 1, according to the present embodiment, comprises: a tying material bobbin holding portion 2; a driving control portion 3; a tying mechanism portion 4; and an encompassing and guiding portion 5. These portions can be detachably assembled simply. The detailed construction of these portions will be described below.

Tying Material Bobbin Holding Portion

In the present embodiment, the tying material bobbin holding portion 2 combines a rear handle 6 and a battery casing 7 so as to rotatably hold a tying material bobbin 8. The tying apparatus, according to the present embodiment, is provided with two handles, i.e., the rear handle 6 and a front handle 24, described later. A rear trigger switch 9 and a front trigger switch 25 are provided at a base portion of the rear handle 6 and at a base portion of the front handle 24, respectively, so that the tying operation can be done by any of the handles. By the provision of two handles, for example, the front handle 24 and the rear handle 6 can be held by one hand and by the other hand, respectively, whereby the tying operation can be done comfortably just like the style of shooting a rifle. Further, the tying operation can be also done in the state where a rear end porion 10 of the tying material bobbin holding portion 2 is suspended on a shoulder and only the front handle 24 is held, and the tying operation can be done very comfortably. The rear end portion 10 is slightly protected rearwardly from the base of the rear handle 6 so that the rear end portion 10 of the tying material bobbin holding portion 2 is easily suspended.

Driving Control Portion

The driving control portion 3 has a tying material feed motor 15, a main motor 16 and a control circuit portion 17 provided with a microcomputer chip mounted within a motor casing 18, which can be integrally mounted and removed from the tying material bobbin holding portion 2 by means of connection bolts 14. The tying material feed motor 15 and the main motor 16 are integrally provided with reduction gears 19 and 20, respectively, and the reduction gear 19 is provided at the output shaft end with a tying material feed roller 21 as tying material feed means, and an output shaft 22 of the reduction gear 20 projects forwardly of the motor casing 18 so that a spindle supported by bearings on the bearing casing of a tying mechanism portion 4, described later, can be mounted.

The tying material feed roller 21 holds a tying material between the former and the other driven roller (not shown) so as to feed the tying material w. The tying material w is guided to a tying material guide pipe 23 provided so as to extend through the motor casing 18 and reach the bearing case of the tying mechanism portion 4 and is fed to the tying mechanism portion 4.

In the present embodiment, since the driving control portion 3, which is subjected to the most severe consumption, can be integrally mounted and removed, for example, when the motor is broken or reaches a predetermined service life, only the driving control portion 3 can be simply replaced with a new one for use. Further, recently, a small motor, which has a long life capable of withstanding about 2,000,000 times of tying, has appeared. In the case where such a motor is employed, since the reduction gear 19, the tying material feed roller 21 and similar first reach the end of their service life as compared with the motor, if the tying material feed roller 21 or similar which has reached its life is replaced, it can be used again as the driving control portion 3, which is economical. Furthermore, since the driving control portion 3 can also be integrally replaced, when the motor is replaced, a program of a microcomputer can be changed according to the connection to a control circuit portion 17 and the performance of the motors, and thus, the motor can be replaced very quickly and positively.

Tying Mechanism Portion

Figure 2:
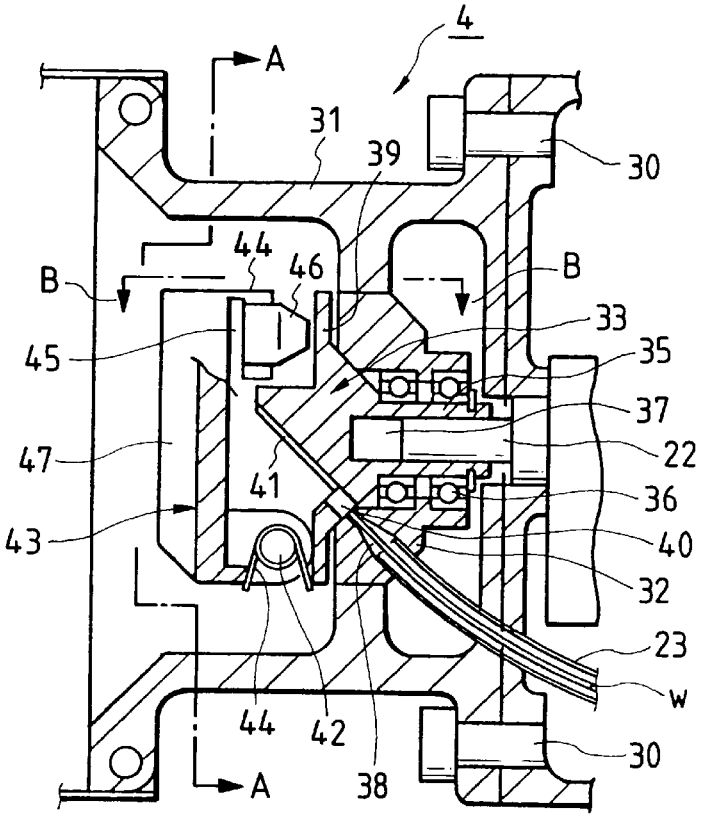
FIG. 2 is an enlarged cross-sectional view of a tying mechanism portion shown in FIG. 1.
Figure 3A:
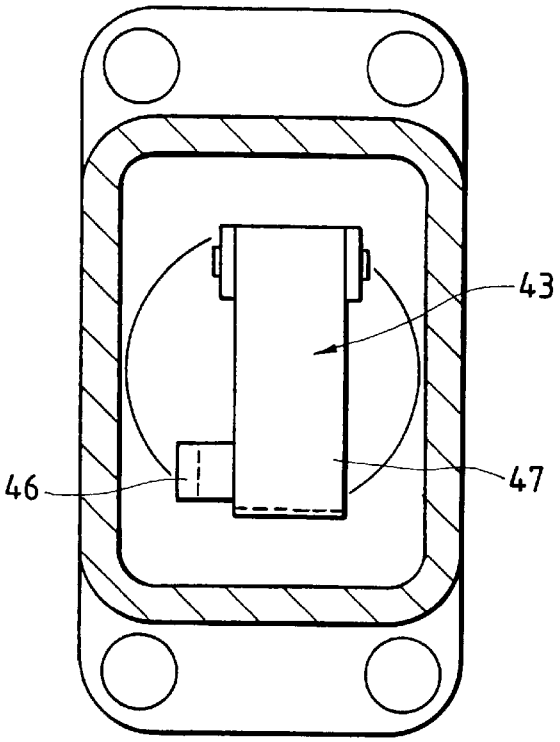
FIG. 3(*a*) is a cross-sectional view taken along line A—A of FIG. 2, and FIG. 3(*b*) is a cross-sectional view taken along line B—B.
Figure 3B:
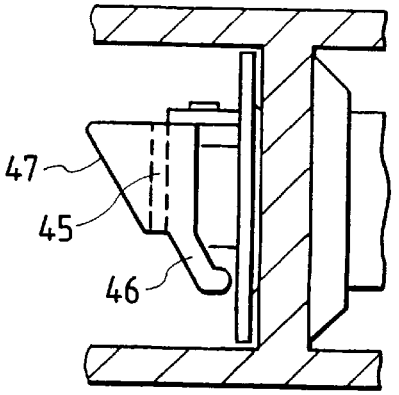

The tying mechanism portion 4 constitutes the most characteristic portion of the present invention, the embodiment of which is clearly shown in an enlarged scale in FIGS. 2 and 3. The tying mechanism portion 4 is held by a spindle casing 31, detachably mounted by means of a connection bolt 30, on the front surface of the motor casing 18 of the driving control portion 3, and comprises, as main members, a bearing casing 32 secured to the spindle casing, a spindle 33, and an oscillating member 43. At a lower portion of the bearing casing 32, a tying material guide hole 38, in which an end of the tying guide pipe 23 is fitted, is obliquely formed from the lower end substantially toward the axial direction of the spindle 33.

The spindle 33 has its shaft portion 35 rotatably supported by bearings in the bearing casing 32 through bearings 36, and a sleeve coupling hole 37, in which the output shaft 22 of the main motor 16 is fitted, is formed in the center portion of the shaft portion 35. A flange 39 is formed forwardly, and the aforesaid flange 39 is formed with a tying material extending-through hole 40 which communicates with the tying material guide hole 38 formed the bearing casing 32 so as to guide a tying material w, being fed by the tying material feed motor 15, obliquely upwardly crossing the spindle axis from the lower portion. Further, an inclined guide surface 41 is projected substantially in a central portion of a flanged surface in order to guide the tying material w which extends through the tying material extending-through hole 40 crossing the spindle axis.

Further, the flange 39 is provided through a shaft 42 with an oscillating member 43 in an oscillating manner. An extreme end portion on the rear surface side of the oscillating member 43 has a folded back member 44, folded back rearwardly, having enough clearance for a tying material w, to be fitted to form a groove-like engaging portion 45, on which an extreme end of a tying material w having been guided by the inclined guide surface 41, impinges and comes into engagement therewith. Further, a hook 46, constituting twisting means in the folded back member 44, is provided so that a release portion, at the extreme end thereof, is vertical with respect to a paper surface in FIG. 2.

On the front surface side (left side in FIG. 2) of the oscillating member 43, an inclined guide surface 47 is formed for automatically guiding a bent extreme end portion of a tying material w, guided around an article not to be tied, through an encompassing guide (described later) so as to cause the former to engage the hook 46. The inclined guide surface 47 is formed to have enough length to cross the extreme end portion of the spindle 33.

The oscillating member 43 is normally biased by a spring 44 fitted in the shaft 42 so as to be maintained at a substantially vertical position as shown in FIG. 2. The spring 44 is formed by two springs, i.e., a weak spring, which is pressed by a tying material w so that the oscillating member 43 is urged by a weak spring pressure until the oscillation in a predetermined range, a strong spring, which exerts with respect to the oscillation in excess of a predetermined range.

Encompassing And Guiding Portion

Figure 1:
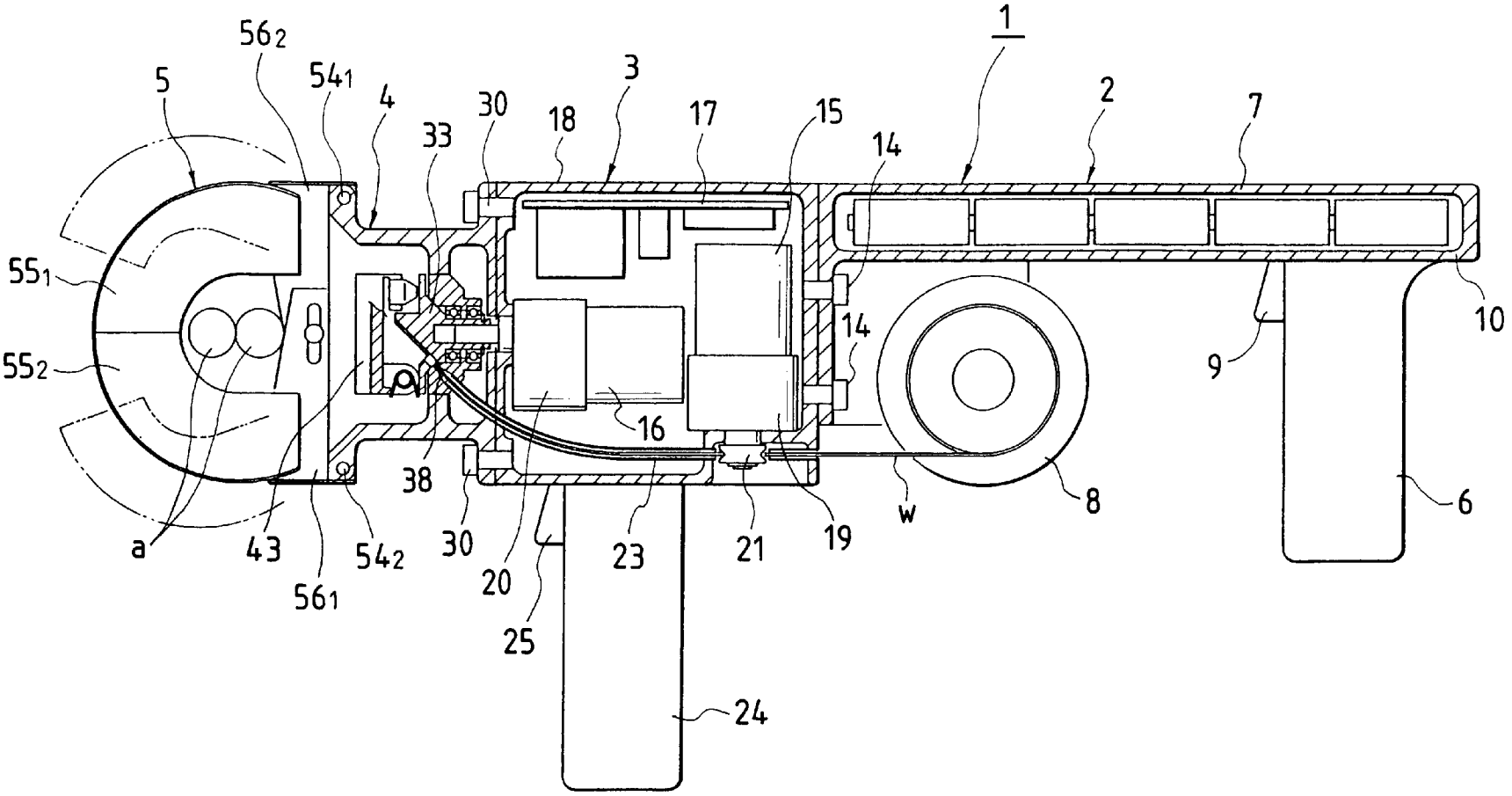
FIG. 1 is a side schematic view in a state where a cover of a casing for a tying apparatus, according to an embodiment of the present invention, is removed.

The encompassing and guiding portion 5 comprises a pair of encompassing guides $\mathbf{55}_1$, $\mathbf{55}_2$ closably pivotally mounted on the extreme end of the tying mechanism portion 4 by means of hinge pins $\mathbf{54}_1$, $\mathbf{54}_2$ and is normally in an open state biased by a spring as shown by the broken line in FIG. 1. The tying apparatus 1 is pressed against articles a to be tied together through an opening whereby articles to be tied engaging members $\mathbf{56}_1$, $\mathbf{56}_2$, formed on the encompassing guides $\mathbf{55}_1$, $\mathbf{55}_2$, are pressed by the articles a to be tied together so that the encompassing guides $\mathbf{55}_1$, $\mathbf{55}_2$ are closed.

Both encompassing guides $\mathbf{55}_1$, $\mathbf{55}_2$ are in the form of a continuously substantially semi-oval in their closed state so that articles a to be tied together can be positioned inwardly of the encompassing guides $\mathbf{55}_1$, $\mathbf{55}_2$. Each of the encompassing guides $\mathbf{55}_1$, $\mathbf{55}_2$ has a substantially U-shaped or V-shaped cross-section whose inside is opened, so that an external tying material b which is external of a tying material w to be fed, while being folded into a substantially U-shape, is moved along the guide surface at the bottom thereof, whereas an internal tying material d is stretched internally of the opening, at least a part of which comes in direct contact with the articles a to be tied together and is guided thereby. While in the present embodiment, both the encompassing guides $\mathbf{55}_1$, $\mathbf{55}_2$ are opened and closed, one of the encompassing guides $\mathbf{55}_1$, $\mathbf{55}_2$ can be fixed. Alternatively, the encompassing guides $\mathbf{55}_1$, $\mathbf{55}_2$ may be automatically opened and closed by suitable actuators.

The tying apparatus 1, according to the present embodiment, is constructed as described above. The tying apparatus 1 is automatically actuated in accordance with a preset program by pressing the trigger switch 9 or 25. While in the present embodiment, a battery, as a driving power source, is encased in a battery casing for convenience of carrying, it is to be noted, of course, that an external power source may be employed so as to supply an external power.

The method for tying articles a to be tied together by the tying apparatus 1, according to the present embodiment constructed as described above, will be explained with reference to FIGS. 1 to 8.

In the state where the encompassing guide 55 is opened as shown by the imaginary line to in FIG. 1, when the article to be tied engaging member 56 is pressed against the outer peripheral portion of the articles a to be tied together, encompassing guide 55 rotates so that the articles a to be tied together assumes a position of the inner peripheral portion of the encompassing guide 55 as indicated by the solid line in FIG. 1. In this state, the trigger switch 9 or 25 is depressed, whereby the tying material feed motor 15 is driven and the tying material feed roller 21 rotates to start the feeding of the tying material w. In this state, the spindle 33 stops with the tying material extending-through hole 40 located so as to be positioned on the extension of the tying material guide hole 38 formed in the bearing casing 32.

The tying material w, delivered from the winding bobbin 8, is guided by the tying material guide pipe 23 and is fitted in the tying material guide hole 38 (FIGS. 1 and 2). The tying material w is further guided to the inclined guide surface 41 in a direction crossing the spindle axis extending through the tying material extending-through hole 40, and the substantially extreme end thereof impinges upon the front surface wall of the oscillating member 43 and slips along the surface thereof into engagement with the engaging portion 45. The oscillating member 43 is pressed by the feeding force thereof and rotates counterclockwise in the figure (FIG. 4(*a*)).

When the tying material w is further fed, and the end of the oscillating member 43 impinges upon the spindle casing, or suitable stopper member, to impede its rotation, the tying material w to be delivered is gradually folded, in its extreme end portion, into a substantially U-shape, as shown in FIG. 4(*b*), by the feeding force thereof to form a starting point of forming two lines.

When the starting point of forming two lines is once formed, the feeding resistance of the tying material w becomes weakened, and the oscillating member 43 is somewhat stood up, from the state shown in FIG. 4(*b*) to the state shown in FIG. 4(*c*), due to the balance of the strong spring with the spring force. Then, the encasing portion 45 assumes a position somewhat upwardly from the spindle axis. In this state, the tying material w is further delivered whereby the extreme end thereof is folded into a substantially U-shape to form a loop and reaches the encompassing guide 55. With respect to the tying material w, at least a part of the external tying material b is restrained by the encompassing guide 55 through the substantially U-shaped folded extreme end portion c and moves along the guide surface at the bottom thereof, whereas the internal tying material d is stretched internally of the opening of the encompassing guide 55, at least a part of which comes into direct contact with the tying material w and moves on while being guided thereby (FIGS. 4(*c*) to FIG. 5(*c*)).

When the folded extreme end portion c is disengaged from the encompassing guide 55, it impinges upon the inclined guide surface of the oscillating member 43 positioned in its moving direction and runs on the inclined surface (FIG. 5(*b*)). The tying material w is further fed whereby it is guided by the folded extreme end guide surface 47 so as to be urged sideways and finally runs on the hook 46 (FIG. 5(*c*)). However, when the tying material w gets over the hook 46, a support, for pressing sideways, is lost so that the folded extreme end portion c naturally moves to a central portion, and the folded extreme end portion c automatically assumes a state wherein it is capable of being stopped at the hook 46 (FIG. 6(*a*)). When assuming this state, an extreme end of a loop is detected by a sensor (not shown) and the feeding of the tying material w is stopped.

Next, the tying material feeding motor 15 is reversely rotated to pull the tying material w in a reverse direction whereby the loop is stopped at the hook 46, and the tying material w is completely disengaged from the guide surface of the encompassing guide 55 to assume a tense state (FIG. 6(*b*)). In the present embodiment, since the tying material w is fed from the lower portion so as to cross the spindle axis, in the state where the tying material w is in a tense state, the proximal end portion of the tying material w is also in a state positioned in the range of rotation of the hook 46. Accordingly, according to the present embodiment, no biasing mechanism is required for bringing the rear end portion of the tying material w into engagement with the hook 46 when twisting starts, and such an engagement can be positively made by a simple mechanism, by reversely feeding the tying material w. The stretched two lines become close so that the two lines are not stretched when tying, and the tying can be done successfully.

The main motor 16 is rotated counterclockwise from the aforesaid state whereby the spindle 33 rotates. At that time, since the tying material w passes through the tying material extending-through hole 40 passing through the tying material guide hole 38 of the fixed bearing casing 32, a relative positional deviation occurs between the tying material guide hole 38 and the tying material extending-hole 40 due to the rotation of the spindle 33 to exert a shearing force on the tying material w, and peripheral edges of both the holes 38, 40 constitute a cutting edge to cut the tying material w easily (FIG. 6(*c*)). In the present embodiment, for facilitating the cutting, the tying material extending-through hole 40 is formed into a spiral slot having an inclined surface with respect to the axis. Accordingly, the tying material w can be cut by a weak force.

When the spindle 33 rotates, the engaging portion 45, as tying material extreme end holding means, provided integrally with the oscillating member 43 mounted on the spindle 33 and the hook 46, also rotate, and in that state, the twisting progresses. At this time, since the hook 46 is pulled toward the articles a to be tied together as the twisting progresses and the oscillating member 43 falls, the twisting can be done in the state where the twisting center coincides with the spindle axis, and the twisting can progress until a clearance, with respect to the articles a to be tied together, disappears. Accordingly, the articles a to be tied together can be firmly tied together to overcome the disadvantages of the prior art.

Further, since the hook 46 and the engaging portion 45 are very close to each other in position, the hook 46 is present on the side of an escape groove of the engaging portion 45, and they are rotated integrally. The end of the tying material w engaged with the engaging portion 45 gradually moves toward the escape groove as the twisting progresses and is automatically disengaged from the engaging portion 45. Therefore, no inferior disengagement occurs, even if a disengaging mechanism is not provided in particular (FIG. 7). By applying a predetermined torque to the spindle 33, termination of tying is automatically detected. By stopping the twisting and reversely rotating the spindle 33 clockwise, the folded portion of the tying material w is simply disengaged and the tying terminates. In this state, when the tying apparatus 1 is pulled to the side, the encompassing guide 55 is opened to remove it from the peripheral portion of the articles a to be tied together. The operation can be quickly shifted to the next mode of operation.

Reinforcements $\mathbf{80}_1$ and $\mathbf{80}_2$ can be tied as shown in FIG. 8(*a*) in the procedure as described above. In the tying by the tying apparatus 1 according to the present invention, since projecting portions of cutting ends 70 and 71 and a loop portion 72 are short from a twisted end, the tying can be carried out by an extremely short tying material w as compared with that of the conventional tying apparatus. This is very effective for saving the tying materials w. Moreover, fastening can also be done.

While one embodiment of the tying apparatus 1 and the tying method, according to the present invention, has been explained, it is to be noted that the present invention is not limited to the aforementioned embodiment, but various changes in design can be made thereto.

For example, in the above-described embodiment, the hook 46 is secured to the oscillating member 43. However, when the hook 46 is provided on the oscillating member 43 so as to be oscillated greatly, for example, by approximately twice the amount of oscillation of the oscillating member 43 by a suitable transmission mechanism, such as a gear, when the tying material w is encompassed and guided around the articles a to be tied together, the hook 46 can be positively moved to a position in engagement with the folded extreme end portion c to provide more positive engagement. As such, the hook 46 is not necessarily secured to the oscillating member 43, but may be designed to be moved freely.

Further, while in the above-described embodiment, the termination of tying is automatically detected by applying a predetermined torque to the spindle 33, and the spindle 33 is automatically reversely rotated and is disengaged from the folded portion of the tying material w, it is to be noted that the present invention is not limited thereto, but the hook 46 is rotated in the same direction as it is and a torque, in excess of a predetermined value, is applied to the spindle 33 whereby the tying material w can be torn off from the neighborhood of the folded portion and the hook 46 can be naturally removed from the tying wire. The tying mode, in case of being tied in such a manner as described, is shown in FIG. 8(*b*).

In this case, a state is assumed wherein the loop portion 72 and the cutting ends 70, 71 are cut away from the twisted end of the tying material w, by which the reinforcements $\mathbf{80}_1$ and $\mathbf{80}_2$ are tied, as shown. According to this method, since it is not necessary that after the completion of tying, there is an advantage in that the spindle 33 is reversely rotated to remove the hook 46 from the loop portion 72, the tying is simple and the control is easy. It is to be noted that the state where the neighborhood of the loop portion 72 is torn off is not always limited to the case shown, but there is a case where the loop portion 72 and the cutting ends 70, 71 are cut in a state of being 3-piece or in a state of being one-piece.

While in the embodiment shown in FIG. 1, the winding bobbin is supported on the tying material bobbin holding portion 2, it is to be noted that the winding bobbin, the driving control portion 3, and similar, may be placed at a position separately from the body of the tying apparatus 1, or they can be carried on the waist by a band or similar to draw therefrom. Further, while in the above-described embodiment, one tying material w is drawn out of one winding bobbin, which is folded into two wires, and the tying is carried out by one winding of the two wires, it is to be noted that two winding bobbins may be mounted to simultaneously draw two tying materials together, which are folded to provide one winding comprising four wires, and further, one winding tying with the number of tying materials more than the above can be made. The number of tying materials is increased, whereby even if a diameter of each tying material is made small, the strength can be enhanced, and a flexibility can be increased to reduce the curvature of the encompassing guide 55, thus further miniaturizing the tying apparatus 1.

While in the above-described embodiment, the front handle 24 is provided at the lower side of the driving control portion 3, the front handle 24 is not necessarily limited to the aforesaid position, but as in a tying apparatus 64 shown in FIGS. 9(*a*) and (*b*), a front handle 66 can be provided sideways of a motor casing 65 of the driving control portion 3, and a suitable position can be selected. Since either structures of the tying apparatus 64, shown in FIG. 9, are similar to these of the previous embodiments, detailed description is omitted.

While in the above-described embodiment, the battery casing 7 is mounted on the body of the tying apparatus 64, it is to be noted that it is convenient if a design is made so as to suitably select, according to the situation of an operation, a case where a battery casing 7 is detachably mounted on the body of the tying apparatus 64 and is mounted on the body, or a case where for example, a battery casing 7 is supported on the waist of an operator and is connected to the body of the tying apparatus 64 through a cable from the waist. In this case, preferably, the battery casing 7 and the body of the apparatus 64 are always linked through the cable in order to prevent inferior contact.

Further, in the case where articles a are tied together, for example, by hard tying materials having a high strength, the encompassing guide 55 receives a high resistance from the tying material w to be opened in order to guide the tying material w around the articles a to be tied together. On the other hand, in a case of a tying machine applied to an application which uses a hard tying material having particularly high strength in order to positively tie the articles a to be tied without opening the encompassing guide 55, it is preferable to provide a locking mechanism which is automatically locked to impede the opening of the encompassing guide 55 in the case where the encompassing guide 55 encases the articles a to be tied together therein.

Further, in the case where a clearance through which the encompassing guides $\mathbf{55}_1$, $\mathbf{55}_2$ move into a position to be tied, such as reinforcements $\mathbf{80}_1$, $\mathbf{80}_2$ placed on the ground or floor surface, is small, it is preferred that rollers are provided outwardly of one of the encompassing guides $\mathbf{55}_1$, $\mathbf{55}_2$ in order to allow the encompassing guides $\mathbf{55}_1$, $\mathbf{55}_2$ to move in easily.

Moreover, while in the above-described embodiment, the tying material w is fed from the lower portion so as to cross the spindle axis, it is to be noted that such is not always necessary, but for example, even if the tying material w is fed by the guiding mechanism in a direction parallel with the spindle axis, similar effects can be obtained. Furthermore, while in the above-described embodiment, the tying material bobbin holding portion 2, the driving control portion 3, the tying mechanism portion 4, and the encompassing and guiding portion 5 are connectable to each other, it is to be noted that the embodiment is not always limited to the above-described embodiment, but for example, a body frame is formed, and a part or whole of the aforementioned portions 2, 3, 4, and 5 can be detachably mounted on the body frame in a cassette system, and in addition, the whole body can be integrally formed.

Further, the tying apparatus according to the present invention is not always limited to a portable type, but for example, a power source and a control portion can be provided outside, or a tying material bobbin can be largely provided outside and mounted on an operating robot. The tying apparatus of the present invention exhibits a great effect in tying and securing reinforcements in the preparation operation as shown in FIG. 8. However, articles to be tied together are not limited to reinforcement, but are also useful for, for example, a tying of articles to be tied together, such as bar-like articles and pipes, and a tying of a single article to be tied, such as a tying of an opening of a bag, and a tying and securing of heat insulating sheets wound about pipes or ducts. There further includes various tyings for raw materials in the production of food, such as ham, and a tying of the meshes in repair of fishing nets or similar. Further, if the tying apparatus body is super-miniaturized and tying materials are selected, it can also be applied to an apparatus for performing medical tying, such as securing and correction after an operation on human beings or animals. The present tying apparatus can be applied to tying of various kinds of articles if the latter can be tied.

FIGS. 10 to 17 show another embodiment of the tying apparatus according to the present invention. Out of these drawings, FIGS. 10 to 13 show another embodiment of the tying mechanism portion of the tying apparatus according to the present invention. The tying mechanism portion in the present embodiment is similar to that of the previous embodiment in fundamental tying method, but unlike the previous embodiment, the present embodiment is characterized in that a spindle body is displaced along the axis as the twisting progresses. In the figures, reference numeral 80 designates a main motor, and 81 designates a sleeve coupling. A spindle 83 is connected to an output shaft 82 of the main motor 80 axially displaceably through the sleeve coupling 81.

An extreme end member 85 is pivotally mounted by a pin 86 in an oscillating manner on the extreme end portion of the spindle 83. The extreme end member 85 is supported on a sleeve 87, rotatably supported by bearings, on a bearing casing 84. The extreme end member 85 can be slidably moved axially with respect to the sleeve 87, but can be rotated integrally with the sleeve 87. The sleeve 87, the extreme end member 85, and the spindle 83 constitute a spindle body. In the vicinity of the base of the extreme end member 85, an inclined surface 88 is formed for reducing a rotational radius of a hook 95 which performs a function of reducing a rotational radius of a hook 95 as the twisting progresses. The spindle 83 is biased leftwardly in the figure by means of a spring 91, provided between a fixed member 89, secured to the body casing and a flange 90, secured to the spindle, so as to return the hook 95 to its initial position.

Further, in the extreme end portion of the extreme end member 85, a guide surface 97 is formed for guiding a tying material to an engaging portion, while being crossed with an axis of a spindle 83, and is provided with a bent extreme end piece 92. An oscillating member 93 is pivotally mounted by a pin 94 in an oscillating manner on the bent extreme end piece 92. The oscillating member 93 is provided with an engaging portion, as tying material holding means, with which an extreme end portion of a tying material engages to bend it into a U-shape, and hook 95.

The tying mechanism portion in the present embodiment is constructed as described above, and the operation thereof will be described with reference to FIGS. 10 to 13. It is to be noted that since the fundamental twisting operation is similar to that of the previous embodiment, only the characteristic operation of the present embodiment will be described.

FIG. 10 shows the state where the hook 95 is at an original position before the tying operation starts. When the tying operation starts, the tying material delivered passes through a tying material guide hole 96 formed in the bearing casing 84, is guided to a guide surface 97, and impinges upon the guide surface of the oscillating member 93. The extreme end portion thereof comes into engagement with the engaging portion, whereby the oscillating member 93 is oscillated forwardly (clockwise in FIG. 10(*b*)) about the pin 94 by the feeding force of the tying material, and is maintained at a position where the hook 95 can be engaged with the bent extreme end portion of the tying material being guided via the encompassing guide, as shown in FIG. 11.

When the bent extreme end portion of the tying material arrives at the position in engagement with the hook via the encompassing guide, the hook 95 rotates into engagement with the bent extreme end portion of the tying material w (FIG. 11 (*a*)) and the tying material is reversely fed, whereby the hook 95 is subjected to tension in a direction of the arrow in FIG. 12, to compress the spring 91 so that the spindle moves in a direction of the arrow in FIG. 12, in which state the twisting starts. As the twisting progresses, the hook 95 is subjected to a force to be gradually pulled in the direction of articles to be tied together, and therefore the spring 91 is further compressed and the spindle 83 moves toward the articles to be tied together. Then, when the inclined surface of the extreme end member arrives at the end of the sleeve 87, the extreme end member 85 can be oscillated about the pin 86 by a clearance between the inclined surface and an extreme end edge of the sleeve 87. As the inclined surface deepens, the extreme end member 85 is inclined to gradually reduce the twisting radius so that the engaging point between the articles to be tied together and the hook 95 assumes a state to be positioned on the twisting center line, in which state the twisting progresses to the end (FIG. 13).

As described above, as the twisting progresses, the hook 95 moves toward the articles to be tied together, and the twisting can be made in the state where the rotational radius of the twisting is gradually reduced so that the engaging point assumes a position on the twisting center line. Therefore, the twisting can be made without occurrence of excessive conical motion in the twisting proximal end during the progress of twisting. It is possible to progress the twisting successfully until a clearance, with respect to the articles to be tied together, disappears without fatigue of the tying material.

FIG. 14 shows another embodiment of the tying apparatus according to the present invention. In the present embodiment, a winding bobbin, a tying material feed motor and a control portion are separated from the tying apparatus body to provide a separate casing. The separate casing is carried on the waist or similar by a band, as shown in FIG. 18, from which a tying material is drawn, whereby the tying apparatus body, to be held in one' hands, can be made light-weight, and the tying operation can be carried out more comfortably and efficiently.

In FIG. 14, reference numeral 100 designates a tying apparatus body, which is held by hands, to carry out a tying operation. A tying mechanism portion is substantially similar to that of the previous embodiment, but a tying material feed motor 101 is separated and is encased in a separate casing body 102, which can be carried on the waist, while being mounted on a band or similar (not shown). The tying apparatus body 100 comprises a main motor 115, a tying mechanism portion 116, an encompassing and guiding portion 117, and a handle 119 having a trigger switch 118. Further, the separate casing body 102 comprises a tying material bobbin holding portion 103 for rotatably holding the tying material bobbin 8, a battery casing 104 for encasing therein a battery as a power source portion, and a control circuit portion 105.

However, a tying material feeding means 106 is provided on the tying apparatus body 100 to transmit a torque of the tying material feed motor 101 to the tying material feeding means 106 through a flexible shaft 107. In the present embodiment, the tying material feeding means 106 has a mechanism in which, as shown in FIG. 14(*b*), a tying material is held between a drive gear 108 and a driven gear 109 to deliver the tying material by means of a frictional force of the drive gear 108, being transmitted to the drive gear 108 through a bevel gear 110 provided on the end of the flexible shaft 107. Further, the tying material feeding means 106 can be detachably mounted together with its casing on the apparatus body as shown so that when a roller is damaged, only that part can be replaced simply. This is also true for the case of an embodiment shown in FIG. 15. In the case of the embodiment of FIG. 15, tying material feeding means 125 is detachably mounted on a separate casing 126.

The tying material w passes, between the separate casing 102 and the tying machine body 100, through a flexible guide tube 111. The guide tube 111 passes through a large diameter flexible pipe 113 collectively together with the flexible shaft 107 and a power source/signal cable 112, and therefore, successful feeding can be obtained without it being bent halfway of feeding or without it being entangled with the flexible shaft or the power source/signal cable. Moreover, in the present embodiment, even if the tying material feed motor 101 is encased in the separate casing body 102, the tying material feeding means 106 is present in the tying apparatus body 100. Therefore, the tying material w is pulled out on the side of the tying apparatus body 100, and is not bent halfway and can be fed satisfactorily with less resistance.

It is to be noted that the tying material feeding means 125 is not limited to the configuration comprising a pair of gears, but suitable means such as a belt system shown in FIG. 15(*b*) and a system having plural pairs of feed gears, shown in FIG. 17 (described later), can be employed. Further, the separate casing body 102 is constructed such that a tying bobbin holding portion 103, a tying material feed motor 101, a control circuit portion 105, and a battery casing 104 are individually separately assembled. For example, when the tying material feed motor 101 or the tying material feeding means 106 is consumed, only the consumed one can be replaced for use. Further, while in the present embodiment, a battery is used as a power source, it is to be noted of course that a commercial power can also be used, in which case a commercial power adapter can be connected to the power source portion.

In the tying apparatus according to the present embodiment, the tying material feed motor 101, the tying material bobbin 8, the battery, and the control circuit portion 104 are encased in the separate casing body 102 and separated from the tying apparatus body 100. Therefore, the tying apparatus can be constructed to be very small and light-weight. Since the separate casing body 102 is attached to the waist or similar for operation, the tying apparatus body 100 held by hands is very light-weight, and even women or children can perform the tying operation comfortably. In this case, it is, of course, that the tying mechanism can be applied to not only the tying machine in the above-described embodiment, but also a tying machine having a tying mechanism of other types.

Further, the tying mechanism portion 116, the encompassing and guiding portion 117 and similar, in the present embodiment, are fundamentally similar to these of the previous embodiment, but in the present embodiment, a spindle 120 is provided with an origin producing cam 121 rotated integrally with the spindle 120, and a detected portion provided at a specific position of an outer peripheral surface of the origin producing cam 121 is detected by an origin sensor 122 provided at a fixed position of the tying apparatus body 100, whereby an origin angle position of a hook 123 can be detected. Thereby, when the tying starts, the hook 123 is located at a position where the hook 123 can always be encased with the bent end of the tying material so that the hook 123 can be positively engaged with the bent end of the tying material to start the twisting.

FIG. 15 shows a modified example of the embodiment shown in FIG. 14, which example is different from the previous embodiment in that tying material feeding means 125 is mounted on a separate casing 126. The tying material feeding means 125 in the present embodiment is composed of a pair of feed belts comprising a drive feed belt 127 and a driven feed belt 123 in order to increase a feeding force. Since other structures are similar to these of the embodiment shown in FIG. 1, the same reference numerals are applied to the same members, and a detailed description is omitted.

FIG. 16 shows a further modified example of the embodiment shown in FIG. 14, in which example, a main motor 130 is also separated from a tying apparatus body 131 and encased in a separate casing body 132 so as to rotate and drive the spindle of the tying apparatus body 131 through a flexible shaft 155. Accordingly, in the case of the present embodiment, the tying apparatus body 131 is further made light-weight. Since other structures are similar to these of the embodiment shown in FIG. 14, the same reference numerals are applied to the same members, and a detailed description is omitted.

FIG. 17 shows another embodiment of the tying material feeding means 135. The tying material feeding means 135, in the present embodiment, is so designed as to feed a tying material by two pairs of gears in order to further increase a feeding force as compared with the case of the pair of gears shown in FIG. 14(*b*). In FIG. 17, reference numeral 136 designates a gear rotated and driven by a tying material feed motor; reference numerals 137, 137' designate drive gears meshed with the first mentioned gear and driven; and reference numerals 138, 138' designate driven gears.

As the tying material feeding means 135, for example, a tying material feeding roller, formed with a spiral groove, is employed to feed a tying material, in a state where the tying material is wound about the roller once or twice, whereby even a tying wire, which is coated, for example, with a synthetic resin, and is thus slippery, can be positively fed.

FIG. 18 shows an embodiment of a tying apparatus mounting holder, in which in the case where the tying operation is carried out by the tying apparatus having the tying apparatus body separated from the separate casing body as in the above-described embodiment, the tying operation can be carried cut comfortably.

The tying apparatus mounting holder 140, in the present embodiment, comprises a belt 141 for detachably holding a separate casing body 150, a tying apparatus body encasing pocket 142 for encasing therein a tying apparatus body 151 held by the belt, and a 'tasuki' body 144 having engaging means 143 for engageably holding a flexible tube 153 which extends from the belt 141 to a shoulder in the form of the 'tasuki' to collectively guide a shoulder portion so as not to get in the way of a tying material, a flexible sheet, a signal wire, etc. extending from the separate casing body 152 to the tying apparatus body 151.

Accordingly, during the tying operation, as shown in FIG. 13(*a*), the separate casing body 102 is attached to the belt and held on the waist, the flexible tube 153 is placed in engagement with the engaging means 143 of the 'tasuki' 141 so that the flexible tube 153 may not slip down from the shoulder, and only the tying apparatus body can be held by one hand to perform the tying operation. The tying apparatus is very light-weight and comfortable as compared with prior art, and the operation can be done successfully without getting in the way of the tying wire, the flexible cable, the signal wire, etc. and the workability can be materially improved. Further, when the operator stops the operation and moves to somewhere, the tying apparatus body 151 can be encased in the tying apparatus body encasing pocket 142 as shown in FIG. 18(*b*). Therefore, the tying apparatus body 151 does not to get in the way and both hands can be used. Thus, the operator can move safely to even a dangerous work site, and in that state, the operator can perform other operations and can carry articles.

As described above, according to the present invention, a continuous linear tying material can be delivered and automatically folded into two wires for tying articles. Therefore, as compared with the prior art in which a single wire is wound to tie articles, the strength of the tying material is enhanced and the articles can be firmly tied with an extremely powerful tying force.

Particularly, in the present invention, the tying material holding means for holding the end of the tying material is rotated and oscillated integrally with the spindle, whereby the tying material holding means is displaced in an axial direction of the spindle. Therefore, the twisting can progress from the neighborhood of the engaging end of the tying material, the tying material can be tied with a short length as compared with the prior art, and the consumption of the tying materials can be reduced. In addition, because of the twisting in the spindle axis, the rotational load of the main motor for twisting will suffice to be less.

Further, since the disengaging action from the engagement holding means exerts on the engaging end of the tying material during the twisting, the disengagement of the engaging end from the engagement holding means can be positively carried out. Further, the hook is mounted on the oscillating member, and the inclined guide surface is formed on the oscillating member whereby the extreme end of the loop can be positively positioned at the hook engaging position, and reliable operation is obtained.

Furthermore, the tying material holding means and the hook are displaced toward the articles to be tied together during the steps of the process, and the tying material holding portion and the hook are rotated integrally at a position very close to each other. Therefore, the twisting can progress until reaching the twist end, and the articles can be firmly tied together. Further, the center of the twist can be twisted on the spindle axis. It is possible to prevent stress from repeatedly exerting on the twisted base portion during the twisting and prevent the tying material from being cut or deteriorated during the twisting.

Further, in the case where the driving control portion of the motor or similar is damaged, it can be replaced together with the motor casing with a new one on-site. Therefore, the operation can continue. The replaced driving control portion of the motor can be recovered and only a damaged portion can be replaced at the factory for re-use, which is economical. Furthermore, the control circuit panel of the driving control portion is integrally replaced, whereby even if the kind of machine is changed, the connection to the control circuit panel and the program of a microcomputer, in accordance with the performance of the motor, can be changed. Therefore, it is possible to replace the panel very simply and positively.

By separating the tying apparatus into the tying apparatus body and the separate casing body, the heavy tying material bobbin and the tying material feed motor can be held on the waist, and the tying apparatus body can be extremely miniaturized and made light-weighted. The tying operation can be carried out very comfortably as compared with prior art this time, even in the tying material feed motor is encased in the separate casing body, when the tying material a feeding means is provided on the tying apparatus body, the tying material is pulled out on the side of the tying apparatus body, and the tying material can be fed successfully with less resistance without being folded halfway.

Industrial Field

As described above, the tying method and the tying apparatus, according to the present invention, both exhibit a great effect in tying reinforcements in the preparation operation. However, the present method and the apparatus are useful for a tying of articles to be tied together, such as not only reinforcement but rods, pipes, etc., a tying of an opening of a bag, a tying of a single article to be tied together, such as winding of heat insulating sheets around pipes and ducts and securing the same. Further, since the apparatus is simple in construction, it is also possible to obtain a super-small and light-weight tying apparatus. If special wires are used as tying materials, they can be applied to a tying apparatus for various articles, such as medical sewing and connection, or sewing and repair of fishing nets or similar. Further, the present tying apparatus can be utilized not only as a portable in use, in which case an operator holds the apparatus by his hands for operation, but also as a tying operation hand attached to a robot arm.

We claim:

1. A method of tying articles comprising:

a tying material bending step of holding a substantially extreme end portion of a continuous linear tying material, being delivered by tying material holding means, to apply a resistance to form a starting point at which said continuous linear tying material is bent into a first substantially U-shape for forming a pair of side-by-side strands of said continuous linear tying material;

an encompassing and guiding step of guiding said continuous linear tying material around an article to be tied, while bending said continuous linear tying material into a second substantially U-shape;

a tying material cutting step of cutting a rear end portion of said continuous linear tying material from a continuous wire at a suitable time; and a twisting step of twisting a U-shaped bent extreme end portion and other side end portion of said continuous linear tying material together to band said article to be tied, wherein during said twisting step, said other side end portion consists of said substantially extreme end portion held by said tying material holding means and said rear end portion being cut off from said continuous linear tying material, and said U-shaped bent extreme end portion and said other side end portion of said continuous linear tying material are twisted together, while said tying material holding means and said twisting means are rotated integrally.

2. The method of tying articles according to claim 1, wherein said continuous linear tying material is fed to a holding portion of said tying material holding means from a direction perpendicular to an axis of a spindle to have said U-shaped extreme end portion engaged with said holding portion.

3. The method of tying articles according to claim 1, wherein said U-shaped bent extreme end portion and said rear end portion of said continuous tying material are twisted together, while said tying material holding means and said twisting means are integrally displaced in an axial direction of a spindle.

4. The method of tying articles according to claim 1, wherein said U-shaped bent extreme end portion and said rear end portion of said continuous linear tying material are twisted together, while said tying material holding means and said twisting means are integrally displaced towards said article to be tied.

5. The method of tying articles according to claim 1, wherein in said twisting step, any one of a predetermined torque and larger is applied to a spindle, even after completion of twisting, whereby a neighborhood of a loop portion of said continuous linear tying material, engaged with a hook of a twisting means, is torn off and a tying end of said continuous linear tying material is disengaged from engagement with said hook.

6. An apparatus for tying articles comprising:

tying material delivery means (21, 106, 125, 135) for delivering a continuous linear tying material;

tying material holding means for holding an end of said continuous linear tying material delivered from said tying material delivery means;

encompassing and guiding means (5, 117) for guiding, around articles to be tied, said continuous linear tying material, while said continuous linear tying material is being bent into a substantially U-shape in a state where a substantially end portion thereof is held by said tying material holding means;

cutting means for cutting said continuous linear tying material into a predetermined length; and twisting means for twisting together a U-shaped bent extreme end portion of said continuous linear tying material and other side rear end portion consisting of an extreme end portion held by said tying material holding means and a cut end portion cut off from said continuous linear tying material, wherein said tying material holding means is provided on a spindle body to be rotated and driven and is rotated integrally with said twisting means.

7. The tying apparatus according to claim 6, wherein said tying material holding means and said twisting means are provided on said articles to be tied as twisting progresses.

8. The tying apparatus according to claim 6 or 7, wherein said tying material holding means and said twisting means are provided on an oscillating member, wherein said oscillating member is provided on said spindle body in an oscillating manner.

9. The tying apparatus according to claim 8, wherein said tying material holding means comprises an engaging portion (45) in which said continuous linear tying material is fittingly provided at a substantially extreme end portion of said oscillating member, and said tying material twisting means comprises a hook (46, 95, 123) provided adjacent to said engaging portion (45) of said tying material holding means.

10. The tying apparatus according to claim 6, wherein a fixed member, for rotatably holding said spindle body, is formed with a tying material guide hole (38, 96) for guiding said continuous linear tying material (w) in a direction perpendicular to an axis of said spindle body, said spindle body being provided with a tying material extending-through hole (40) which communicates with said tying material guide hole to cause said continuous linear tying material to extend through in said direction perpendicular to said axis of said spindle body, said continuous linear tying material being held by said tying material holding means from said direction perpendicular to said axis of said spindle body.

11. The tying apparatus according to claim 10, wherein said cutting means is formed by edges of both said tying material guide hole and said tying material extending-through hole, and said continuous linear tying material is cut from a continuous line by relative rotational movement between said tying material guide hole and said tying material extending-through hole.

12. The tying material according to claim 8, wherein said spindle body is provided so as to be displaced toward said articles to be tied as twisting progresses.

13. The tying material according to claim 12, wherein said spindle body comprises a spindle (83), rotated and driven by a main motor (80), and a spindle extreme end portion (85), pivotally mounted on an extreme end of said spindle, and wherein said oscillating member is provided at a substantially extreme end portion of said spindle extreme end portion so that as said spindle body is displaced toward said articles to be tied as twisting progresses, said spindle extreme end portion (85) oscillates so as to reduce a rotational radius of said twisting means.

14. An apparatus for tying articles comprising:

a tying material bobbin holding portion (2);

a driving control portion (3);

a tying mechanism portion (4);

an encompassing and guiding portion (5);

a tying material cutting portion;

wherein said driving control portion comprises:

a tying material feed motor (15);

a main motor (16) for rotating and driving a spindle body of said tying mechanism portion; and a control circuit portion (17) for controlling said tying material feed motor (15) and said main motor;

wherein said tying mechanism portion (4) comprises:

tying material holding means (45) for holding an end of a continuous linear tying material; and twisting means (46) for twisting together a U-shaped extreme end portion of said continuous linear tying material and other side rear end portion consisting of said extreme end portion held by said tying material holding means and a cut end portion cut off from said continuous linear tying material; and wherein said driving control portion (3) is capable of being integrally detached with respect to said tying material bobbin holding portion (2) and said tying mechanism portion (4).

15. A tying apparatus comprising:

tying material feed motor (101);

tying material feed means (106, 125, 135) rotated and driven by said tying material feed motor;

a main motor (115, 130);

a tying mechanism portion twisting means (46) which is rotated and driven by said main motor, wherein a tying mechanism portion (4) comprises tying material holding means (45) for holding an end of a continuous linear tying material, and twisting means for twisting together an U-shaped bent extreme end portion of said continuous linear tying material and other side rear end portion consisting of said extreme end portion held by said tying material holding means and a cut end portion cut off from said continuous linear tying material; and wherein said tying apparatus is separated into at least a body of said tying apparatus (100, 131) having said tying mechanism portion and at least a separate casing body (102, 126, 132) having said tying material feed motor, and said continuous linear tying material is fed from said separate casing to said tying mechanism portion of said body of said tying apparatus by said tying material feed motor (101).

16. The tying apparatus according to claim 15, wherein said main motor (130) is provided on said separate casing body (132), and said tying mechanism portion is rotated and driven through a flexible shaft (155) from said main motor.

17. The tying apparatus according to claim 15, wherein said main motor (115) is provided on said body of said tying apparatus.

18. The tying apparatus according to claim 15, wherein said tying material feed means (106) is detachable from any one of said tying apparatus body (100, 131) and said separate casing body (126).

19. The tying apparatus according to claim 15, 16, 17, or 18, wherein said tying material feed means is present in said body of said tying apparatus, said tying material feeding means being rotated and driven through a flexible shaft from said tying material feed motor (101) which is present in said separate casing body (102, 132), and said continuous linear tying material is drawn out of a tying material bobbin (8) held on said separate casing body (102, 132) of said body of said tying apparatus (100, 131).

* * * * *